US008997777B2

(12) United States Patent
Montague

(10) Patent No.: US 8,997,777 B2
(45) Date of Patent: Apr. 7, 2015

(54) FIRE HYDRANT SECURITY INTEGRATED FLOW CONTROL/BACKFLOW PREVENTER INSERT VALVE

(75) Inventor: Albert Montague, Brooklyn, NY (US)

(73) Assignee: Albert Montague, Brooklyn, NY (US)

( * ) Notice: Subject to any disclaimer, the term of this patent is extended or adjusted under 35 U.S.C. 154(b) by 0 days.

(21) Appl. No.: 13/550,585

(22) Filed: Jul. 16, 2012

(65) Prior Publication Data

US 2013/0042924 A1 Feb. 21, 2013

Related U.S. Application Data

(60) Provisional application No. 61/508,107, filed on Jul. 15, 2011.

(51) Int. Cl.

| | |
|---|---|
| ***E03B 7/10*** | (2006.01) |
| ***E03B 9/02*** | (2006.01) |
| ***A62C 35/20*** | (2006.01) |
| ***A62C 35/68*** | (2006.01) |
| ***E03B 9/04*** | (2006.01) |
| ***E03C 1/10*** | (2006.01) |

(52) U.S. Cl.

CPC ..... *A62C 35/20* (2013.01); *A62C 35/68* (2013.01); *E03B 9/04* (2013.01); *E03C 1/104* (2013.01)

(58) Field of Classification Search

CPC ..... E03B 9/14; E03B 7/12; E03B 9/02; A62C 35/20; F16L 55/07

USPC ..... 137/60, 61, 107, 272, 281, 301

See application file for complete search history.

(56) References Cited

U.S. PATENT DOCUMENTS

| | | | | |
|---|---|---|---|---|
| 4,483,361 | A * | 11/1984 | Jungbert, Sr. | 137/301 |
| 6,058,957 | A * | 5/2000 | Honigsbaum | 137/1 |
| 6,561,214 | B2 * | 5/2003 | Heil | 137/307 |
| 7,174,911 | B2 * | 2/2007 | Davidson | 137/299 |
| 7,240,688 | B2 * | 7/2007 | Davidson et al. | 137/15.02 |
| 7,267,136 | B2 * | 9/2007 | Fleury et al. | 137/71 |
| 7,775,231 | B2 * | 8/2010 | Davidson et al. | 137/15.02 |
| 2008/0029161 | A1 * | 2/2008 | Montague | 137/217 |
| 2009/0223574 | A1 * | 9/2009 | Montague | 137/519.5 |
| 2010/0071123 | A1 * | 3/2010 | Larsen | 4/508 |

* cited by examiner

*Primary Examiner* — John K Fristoe, Jr.

*Assistant Examiner* — Kevin Barss

(74) *Attorney, Agent, or Firm* — Kramer Levin Naftalis & Frankel LLP

(57) ABSTRACT

Integrated flow control backflow preventer valve ("IF-CBPV") for new and existing wet- and dry-barrel fire hydrants, with barrel drain assemblies for dry-barrel hydrants, and hydrants equipped with such IFCBPVs, are presented. An exemplary IFCBPV can have a retaining screen comprising equidistant concave radial spokes intersecting at a central ring structure, a freely suspended check ball, and a lower ball seat with a seal. The upper surface of the retaining screen can be affixed to the hydrant's axial shaft, and can thus be used to open and close the hydrant via the ball. Alternatively, the retaining screen can be fixed and the axial shaft provided with a cup on its bottom that mates with the freely suspended ball that is caged between the retaining screen and the ball seat. An exemplary barrel drain assembly can comprise a spring-loaded piston, or alternatively, a check ball design as in the main barrel.

18 Claims, 17 Drawing Sheets

FIRE HYDRANT SECURITY INTEGRATED FLOW CONTROL/BACKFLOW PREVENTER INSERT VALVE

CROSS-REFERENCE TO RELATED APPLICATIONS

The present application claims the benefit of U.S. Provisional Patent Application No. 61/508,107, filed on Jul. 15, 2011, entitled "Fire Hydrant Security Integrated Flow Control/Backflow Preventer Insert Valve.

TECHNICAL FIELD

The present invention relates to public health and safety, and in particular to an advanced prophylactic fire hydrant valve design that can (i) prevent the accidental or intentional introduction of Chemical, Biological or Radiological (CBR) toxic agents; (ii) improve hydrant performance; and (iii) reduce hydrant maintenance costs.

BACKGROUND OF THE INVENTION

A fire hydrant is one of the most easily accessible elements of a regional potable water distribution system. If improperly used as an entry point for the accidental or intentional introduction of significant amounts of a toxic Chemical, Biological or Radiological (CBR) agent into the potable water distribution system, it can be readily converted to an instrument of illness, death, and destruction. Such an introduction of a toxic agent not only compromises the safety of an entire regional potable water supply system, it can even affect its future use, such as where significant affected portions of the piping system must be replaced.

Fire hydrants are connected directly to a municipal potable water supply system via a lateral pipe. The lateral pipe is in-turn connected to an entire regional potable water distribution system. Obviously, the primary use of a fire hydrant is to enable firefighters to connect their hoses to the municipal water supply system so as to extinguish a fire. Fire hydrant valves are not designed to throttle the water flow; rather, they are designed to be operated in either a full-on or a full-off setting.

In addition, a conventional hydrant's main valve is occasionally exposed to large suspended solids, such as pebbles. This exposure, which is caused by deterioration of the pipes in the water conveyance system, prevents the hydrants main valve seal from properly sealing, i.e., making compressive contact with the hydrant's seal ring and ceasing all flow. These design and operational problems are well known, and can occasionally cause costly site damage.

For example, *Fire Hydrant Maintenance* (Kennedy Valve Company), A 4.15, at p. 1 states that "[t]he most common maintenance need relates to obstructions in the seating area and resulting damage to the main valve. This is detectable by continued flow with the hydrant in the closed position." Further, at p. 2, the "[f]unction of the drain valve system needs to be checked for proper operation. There are two primary issues that can cause a need for related maintenance, 1) Hydrant barrel fails to drain after use—which subjects it to freeze damage, and 2) During full open hydrant operation, continuous discharge of water is taking place—which can undermine support for the installation."

Additionally, as described in the National Drinking Water Clearing House Manual, *How to Begin an Operation and Maintenance Program* (University of West Virginia, 2009), at 2: "Dry-barrel hydrants should always be opened fully because the drain mechanism operates with the main valve. A partially opened hydrant can cause water to be forced out through the drains and cause erosion around the base of the hydrant."

The current and conventional remedy to these problems is frequent and costly field inspections, maintenance and repairs.

It is well known that use of a fire hydrant in a partially-open configuration can result in considerable flow directly into the soil surrounding the hydrant, which, over time, can cause severe scouring. Moreover, the fact that either a hose with a closed nozzle valve, a fire truck connection, or a closed gate valve is generally attached to the hydrant prior to opening the hydrant's main valve, can further exacerbate this problem.

In order to prevent casual use or misuse, all hydrants require special tools to be opened. This is usually a large wrench with a pentagon-shaped socket. Vandals occasionally cause monetary damage by wasting water when they open a fire hydrant. Such vandalism can reduce municipal water pressure, and can create a potential local backflow problem due to concomitant uncontrolled and sustained reduction in system water pressure. Ultimately, this can impair firefighters' efforts to extinguish fires. Additionally, in most areas of the United States, contractors who need temporary water can purchase permits to use fire hydrants. Such a permit generally requires a hydrant meter, a gate valve and sometimes a clapper valve to prevent backflow into the hydrant.

Generally, municipal service vehicles, such as tank trucks and street sweepers, are permitted to use fire hydrants to fill their water tanks. Similarly, sewer maintenance vehicles frequently require water to flush out sewer lines, which is accomplished by filling their tanks from a nearby hydrant. Unauthorized entities who gain access to this type of mobile tanker, which can contain, for example, 5000-8000 gallons of liquid, can easily introduce a significant quantity of dangerous CBR agents into a water system by injection into a hydrant's discharge ports. Such a successful injection can be accomplished by simply increasing the pressure of the liquid in the tanker so that it is greater than the pressure in the municipal water supply distribution system that provides water to the fire hydrant. Less likely, although possible, is the injection of a contaminant through the external dry barrel hydrant drain holes using a collar. It is noted in this context, that if toxic radiological contaminants were to be injected into the piping system, the result could be catastrophic, inasmuch as cleaning or removing such contamination can require the complete replacement of the entire regional water supply pipe distribution system, as well as potable water supply pipes in those buildings that were subjected to the radiologically contaminated water.

Many of the aforementioned public health and safety concerns were clearly characterized in Ernest Lory, Stephen Cannon, Vincent Hock, Vicki VanBlaricum and Sondra Cooper, *POTABLE WATER CBR CONTAMINATION AND COUNTERMEASURES* (Naval Facilities Engineering Service Center, 2006). Quoting from the authors' general introductory comments:

> This paper provides information on the potential threat to a building's domestic and potable water supplies from CBR agents that could potentially be used by terrorists (taking into consideration they would likely use low-technologies or agents most readily available). People, both mission critical and the general population, are the most commonly targeted assets of aggressors using CBR agents. CBR agent threats can come from wartime or terrorist attacks or accidental or intentional (sabotage) industrial chemical releases. It is generally assumed that the catastrophic consequences of a CBR terrorist attack or industrial release would be short in duration, perhaps lasting only a few hours. However, (emphasis added) decontaminating a potable water distribution system of a CB agent may take several days. Radioactive material releases can contaminate a water distribution system making it unusable for months or even years creating an enormous health impact. If a small military camp was targeted, the camp could be moved, but if a large distribution system was attacked, the problem of supplying water could be detrimental."

This report offers three primary countermeasures available to either overcome or reduce the potential introduction of CBR agents into water supplies:

"These countermeasures in order of priority are: (1) contamination avoidance, such as the use of protective barriers; (2) use of CBR agent detection, measurement, and identification instrumentation or methods; and (3) CBR agent treatment to minimize water distribution disruption, such as removal by filtration and disinfectant techniques. These priorities are established to reflect the greatest potential return in terms of operational effectiveness, and conservation of resources and manpower. That is, (emphasis added) the greatest benefit by far will be achieved by using contamination avoidance techniques and procedures in advance of an expected attack and subsequent to an attack."

As described below, the present invention uses a protective barrier approach, thus clearly satisfying the report's preferred countermeasure approach of "contamination avoidance."

As noted in U.S. Utility patent application Ser. No. 11/810,946, for "Backflow Preventer Insert Valve," filed Jun. 6, 2007 and published as US 2008/0029161, backflow preventers are used to prevent contamination of a building and/or public water distribution system by reducing or eliminating backflow of a contaminated hazardous fluid into such system(s). Conventional backflow preventers are mechanically sophisticated devices, that are threaded for pipes, unthreaded for tubing, or flanged at each end so that they can be installed, i.e., spliced, into a given piping system. Conventional backflow preventers require periodic inspection, testing, maintenance and repair. Therefore, needing to be visible and accessible, they are not tamper resistant. Thus, a conventional backflow preventer is generally installed in a source pipeline between a main municipal water supply line and a service line that feeds an installation such as, a hospital, industrial building, commercial establishment, multiple or single family residence. Moreover, a conventional backflow prevention valve typically includes two check valves that are configured to permit fluid flow in one direction, such as from a main municipal water supply distribution system to a particular building's service line. They are costly and labor intensive to install. Conventional backflow preventers are commonly used in buildings equipped with chemical processing equipment, sprinkler systems, etc. Backflow preventers are required by applicable plumbing codes, under specific conditions, to protect a building's potable water supply from accidental contamination so as to prevent a hazardous condition from materializing, which can occur from cross connection and flow reversal in a branch or pipe riser, due to a process or system malfunction. Left unchecked, hydraulic reversal can compromise the quality and safety of a building's potable water supply system and, potentially, the municipal water supply distribution system as well.

Historically, a typical backflow preventer valve consisted of a mechanical single spring-loaded check valve in a water supply line, generally placed between a pair of gate-type shutoff valves. Current building codes however, now require backflow preventers to include a pair of independently spring-loaded positive check valves. The motivation behind such a rule is that should one of the check valves fail, the second valve serves as a backup. Because of their mechanical complexity, current plumbing codes typically require that the check valve(s) be replaceable and repairable while on-line, i.e., without shutting down the system. However at the same time current plumbing codes for commercial, industrial, multi-story residential buildings and single homes do not require the installation of backflow preventers at every point of use. This leaves such buildings' internal drinking water supply vulnerable to injection of a toxic chemical, radiological or biological contaminant into the building's water supply system, with the added possibility of contaminating the municipal water supply distribution system in the process. Were the latter to occur, the water quality of an entire regional water distribution grid could be affected. Measures are needed to address this critical gap in security.

As noted, municipal codes generally require the replacement of single check valves with a double check valve backflow preventer. However, simply requiring building owners to undertake major re-plumbing and install these backflow preventers between the municipal water service distribution lines located in the street and downstream of the building's water meter does not address a given building's vulnerability to intentional contamination from within. Retrofitting a conventional backflow preventer to protect a building's internal potable water distribution system from possible intentional contamination at every point-of-use water supply terminus, such as, for example, by installing shutoff valves for all kitchen and bathroom fixtures, drinking fountains, hose bibs, etc., can be very expensive. First, each existing supply line would have to be re-plumbed to provide space to accommodate a conventional check valve assembly. Second, access for repair and replacement would be required for the maintenance of each such backflow preventer, since, as noted, these devices tend to be mechanically complex. Even in new construction, installation of conventional back flow preventers for each point-of-use fixture would be costly.

In the Jun. 18, 2004 article *Cross Connection Control Programs And Backflow Preventers Are Essential Components of Safe Drinking Water Systems*, published on the website backflowpreventiontechzone (at URL http://www.Backflowpreventiontechzone.com), it was noted that plumbing system cross connections between (i) potable and (ii) non-potable water supplies, water using equipment, and drainage systems, continue to be a serious global potential public health hazard. Wherever people congregate and use communal water supplies, water using equipment, and drainage systems, the danger of un-protected cross connections continues to threaten public health. Thus, there is a widening recognition that properly installed, maintained, and tested backflow prevention devices are critical elements of safe drinking water systems in homes, communities and workplaces. The report further noted that while backflow preventer device development began to accelerate and diversify beyond simple check valves in the mid-20th century, potable ("city") water piping systems and water using equipment, especially as found inside industrial and medical buildings, have grown exponentially in complexity and are also continuously altered. Surveys over the past decades have shown that water using devices and equipment which can potentially contaminate a drinking water system continue to be connected to potable waterlines without properly selected, permitted, installed, maintained, and, if appropriate for the device, tested and certified, backflow preventer valves. Thus, "despite decades of new public health and occupational safety laws, as well as updated and revised plumbing codes, along with new improved backflow preventer devices, the cross connection problem continues to be an ongoing dynamic one."

The backflowprevetiontechzone report further noted that recent cross connection inspection surveys (USC/FCCCHR) continue to reveal that the most prevalent and potentially hazardous potable water plumbing cross connection is the common hose connection (or hose bib) (UF/IFAS, 3/95), which is found in virtually every home and building. The predominant cause for such cross connection, known as back-siphonage, is the sudden and significant loss of hydraulic pressure in the water main. Excessive drops in water pressure have historically been attributed to, for example (i) a broken water main, (ii) a nearby fire where the Fire Department is using large quantities of water, or (iii) a water company official opening a fire hydrant to test it. Buildings located near a municipal water main break or an open fire hydrant will thus experience a lowering of water pressure and possibly back-siphonage.

A recent GAO-04-29 report to the United States Senate Committee on Environment specifically referenced fire hydrants as a top vulnerability, saying "[m]oreover, as recently reported by the American Water Works Association on May 2, 2007, terror training manuals found in Afghanistan showed plans to contaminate America's water supply."

As noted above, hydrant security is currently relatively vulnerable to breach by a cunning terrorist. Using a tanker truck or pool, either at or relatively close to a hydrant, a toxic contaminant can be easily injected into the hydrant, and thus, the relevant regional water supply distribution system. All that is required is a hose connected to a hydrant discharge port and a pump having sufficient operating pressure to overcome the fluid pressure at the hydrant. Though more challenging, a hydrant's dry barrel discharge holes could also be turned into a water system entry point by using a specially tailored outside saddle valve.

It is noted that in areas known to be subjected to freezing temperatures, only a portion of the hydrant is above ground. Thus, in such hydrants, the main shut-off valve must be located below grade (ground level), immediately below the frost line. Such a main shut-off valve is generally connected using a vertical shaft above-ground mechanism, where a valve shaft (stem) with a break-away coupling extends from the main valve up through a seal at the top (bonnet) of the hydrant, where it can be operated with the proper tool. This design is known as a "dry barrel" hydrant, in that the barrel, or cylindrical body cavity of the hydrant, is normally dry. In a dry barrel hydrant, a drain valve located underground, at the bottom of the barrel housing, opens when the hydrant's main water valve is completely closed, thus allowing any water in upper section of the hydrant's body to automatically drain to the surrounding soil. This feature prevents the upper barrel of the hydrant from freezing, which can cause structural damage to, and/or breaking of, the hydrant.

In warmer areas, hydrants can be used with one or more valves in the above-ground portion. Unlike cold-weather hydrants, it is possible to turn the water supply on and off to each port. This style of hydrant is known as a "wet barrel" hydrant.

Both wet and dry barrel hydrants generally have multiple outlets. Wet barrel hydrant outlets are typically individually controlled, whereas a single stem simultaneously operates all of the outlets of a dry-barrel hydrant. Thus, wet barrel hydrants allow single outlets to be individually opened. A typical U.S. dry-barrel hydrant has two smaller outlets and one larger outlet.

Differential pressure reversals at a given fire hydrant can be attributed to many things. For example, vandals, or a fire located remotely where the demand for water adversely affects the pressure at other locations in the water supply distribution system.

Given the vulnerability of fire hydrants, and thus the entire regional potable water system to which they are connected, an improved and more secure fire hydrant with an integrated flow control/backflow preventer valve is truly needed.

What is further needed in the art is a fire hydrant backflow preventer valve that is economical to manufacture and maintain, essentially maintenance-free and tamper resistant.

SUMMARY OF THE INVENTION

An integrated flow control backflow preventer valve ("IFCBPV") for new and existing wet-barrel and dry-barrel fire hydrants is presented. Additionally, dry-barrel fire hydrants equipped with such an IFCBPV having an integrated barrel drain with only one moving part—a ball, that is self-cleaning and essentially maintenance free, are presented. An exemplary IFCBPV has a retaining screen comprising equidistant concave radial spokes which intersect at a central ring structure, a freely suspended ball, and a lower ball seat at the bottom of the IFCBPV assembly. The upper surface of the retaining screen can be affixed to the hydrant's upper stem or axial shaft, and can thus be used to open and close the hydrant via the ball. To close the hydrant the retaining screen is lowered, and the freely suspended ball concomitantly pushed downward by the bottom of the retaining screen so as to be held between the bottom of the retaining screen and the top of a sealable lower ball seat. The sealable lower ball seat can be provided with an "O" ring or other fluid sealing material or device. To open the hydrant, the retaining screen is raised—via the hydrant's stem—so as to allow the ball to move up from the sealable lower ball seat vertically within the valve body, which permits normal fluid flow around the ball and through the retaining screen's central hole and three port holes.

In an alternative exemplary embodiment of the present invention, the retaining screen can be at a fixed position, not connected to the axial shaft, while the axial shaft can have a cup affixed to its lowest point. Said cup can have an inner surface that perfectly matches the surface dimensions of the freely suspended ball. The axial shaft and the cup can have an outer diameter that is slightly smaller than the central hole in the retaining screen. Thus, to close the hydrant, the axial shaft is lowered, moving said cup through the central hole of the fixed retaining screen, and pushing the ball downwards into the lower ball seat, which achieves the same effect as when the axial shaft and the retaining screen are connected. To open the hydrant, the axial shaft is raised, raising the cup at the end of the axial shaft so as to free the ball to move up from the sealable lower ball seat vertically and into the retaining screen that is fixed in position within the valve body, which permits normal fluid flow around the ball and through: (i) the port-holes of the three radial spokes of the concave retaining screen, and (ii) for those flow lines which impinge on the three concave radial spokes, flow is redirected through the retaining screen's central hole.

However, even with the valve open, and regardless of whether the chosen design has the axial shaft and retaining screen connected, if flow reverses to a backflow condition, or a backflow pressure develops, the ball will immediately seat on the sealable lower ball seat, i.e., "O" ring affixed thereto, thus preventing backflow, and isolating the water supply from the barrel of the hydrant.

The entire valve housing can have, for example, male threads provided on the bottom of its outer perimeter, which can mate with the female threads commonly found at the bottom of a fire hydrant's lower barrel (where conventionally a main valve seat ring is provided). Thus, the valve housing can be readily inserted into and removed from an existing hydrant.

For dry-barrel hydrants, the valve housing can further comprise two or more internal independent barrel drain assemblies, which provide an open path to hydrant drains when the valve is closed, thus allowing the upper barrel of the hydrant to drain post use. Each barrel drain can, for example, be controlled by a spring loaded piston which opens the drain as the retaining screen lowers to its bottom position, and closes the drain as the retaining screen is raised. Or, alternatively, the barrel drains can have a ball that moves between a backflow preventing upstream seat (hydrant closed, backflow condition in drain line), a medial seat to allow the hydrant barrel to drain (hydrant closed, or very beginning of forward flow) and a downstream seat preventing leakage (normal forward flow or backflow condition in hydrant). The upstream and the downstream positions both prevent flow through the barrel drain, and the medial position of the ball allows it. Thus, in either barrel drain type, when the hydrant is first being opened (and there is a rather small forward flow) the drains remain open, and because the ball moves off of the sealable lower ball seat, water also flows from the supply. This combination of features allows the hydrant to momentarily purge, i.e., flush out, any solids (i.e. pebbles) that may be in the barrel drain line to the external soil environment, and then instantly close when the main hydrant valve is partially or totally open. When the hydrant is in use (regardless of the rate of flow) and the main valve of the fire hydrant is partially or fully opened, the dry-barrel drains are closed, thereby preventing any flow or leakage that could otherwise scour the external soil or fill material that holds the hydrant securely in place. Conventional fire hydrants fail to protect the soil in this way.

In exemplary embodiments of the present invention, the valve housing can have a multifunctional cylindrical vertical sleeve extension, with upper posts affixed on its upper portion. The sleeve extension can have a smooth inner surface so as to reduce head loss of the hydrant, and the posts can be used to screw and unscrew the valve housing into and out of the hydrant's lower barrel. It is recommended that said posts be removed once the IFCBPV is installed to improve security.

Alternatively, instead of the cylindrical sleeve (valve body extension), the main valve housing can have at least two keyed slots located at its upper edge that can be used with the proper tool, such as a spanner wrench, to secure or remove the valve from the fire hydrant's lower barrel inner (female) thread.

BRIEF DESCRIPTION OF THE DRAWINGS

FIG. 1 depict three exemplary cross-sectional views of a conventional fire hydrant provided with an exemplary integrated flow control backflow preventer insert valve and barrel drain assembly according to an exemplary embodiment of the present invention;

FIG. 4A (right image) depicts a bottom (viewer facing downstream) cross-sectional view of the exemplary retaining screen of FIG. 4A (left image) showing an exemplary ball seat having concave spokes and a central ring structure;

FIG. 12 depict three exemplary cross-sectional views of a dry-barrel fire hydrant provided with an exemplary integrated flow control backflow preventer insert valve as in FIG. 1; however, the barrel drains in these figures are of the type depicted in FIGS. 9-11, and the axial shaft has a cup affixed to its lowest point and is not connected to the retaining screen; rather, the retaining screen is at a fixed location;

DETAILED DESCRIPTION OF THE INVENTION

The present invention will be described with reference to various exemplary embodiments. It should be understood that none of such descriptions are limiting, and all descriptions of exemplary embodiments and their respective components are exemplary, and for illustrative purposes. The present invention is understood to be capable of implementation in various other embodiments and variations of embodiments than those described herein, as will be understood by those skilled in the art.

As noted above, there is a compelling need to address the security vulnerability of fire hydrants, with an improved design having lower maintenance costs. In exemplary embodiments of the present invention, an integrated flow control/backflow preventer valve ("IFCBPV") and drain apparatus is presented that is (i) simple in design and operation, (ii) essentially maintenance free, (iii) economical and cost-effective as to operation and manufacture, (iv) tamper-resistant, (v) simple to install (retro fit) without having to remove the hydrant, (vi) not readily accessible by anyone other than authorized personnel and (vii) exhibits very low head loss. Using such an IFCBPV, a hydrant can cease to be prone to fouling by solids, can be corrosion resistant and essentially maintenance free, and, if dry barrel, can have a drain that is functional only when the hydrant is completely closed.

In general, to improve hydrant security against unauthorized use, all street laterals should be and remain closed, unless needed by an appropriate regulatory entity. However, they should always be in perfect working order and readily available for the fire department or other authorized users.

In exemplary embodiments of the present invention, an IFCBPV assembly and cylindrical housing can be insertable into an existing hydrant. In exemplary embodiments of the present invention, the entire IFCBPV assembly depicted in, for example, FIG. 2 comprising everything between the shaded grey areas, would replace the lower assembly of a conventional hydrant depicted in FIG. 15. Specifically, the IFCBPV assembly from FIG. 2 would replace everything in FIG. 15 except for outer walls 12 and 14 of the hydrant itself and the lateral pipe below. Thus an IFCBPV is an insertable valve, and can, for example, be easily used in retrofits. Moreover, it can have, for example, an outside mating thread that can be readily threaded (using an appropriate tool) into a fire hydrant's existing lower barrel main valve thread, commonly known as the "main valve seat ring" thread connection.

Figure 2:
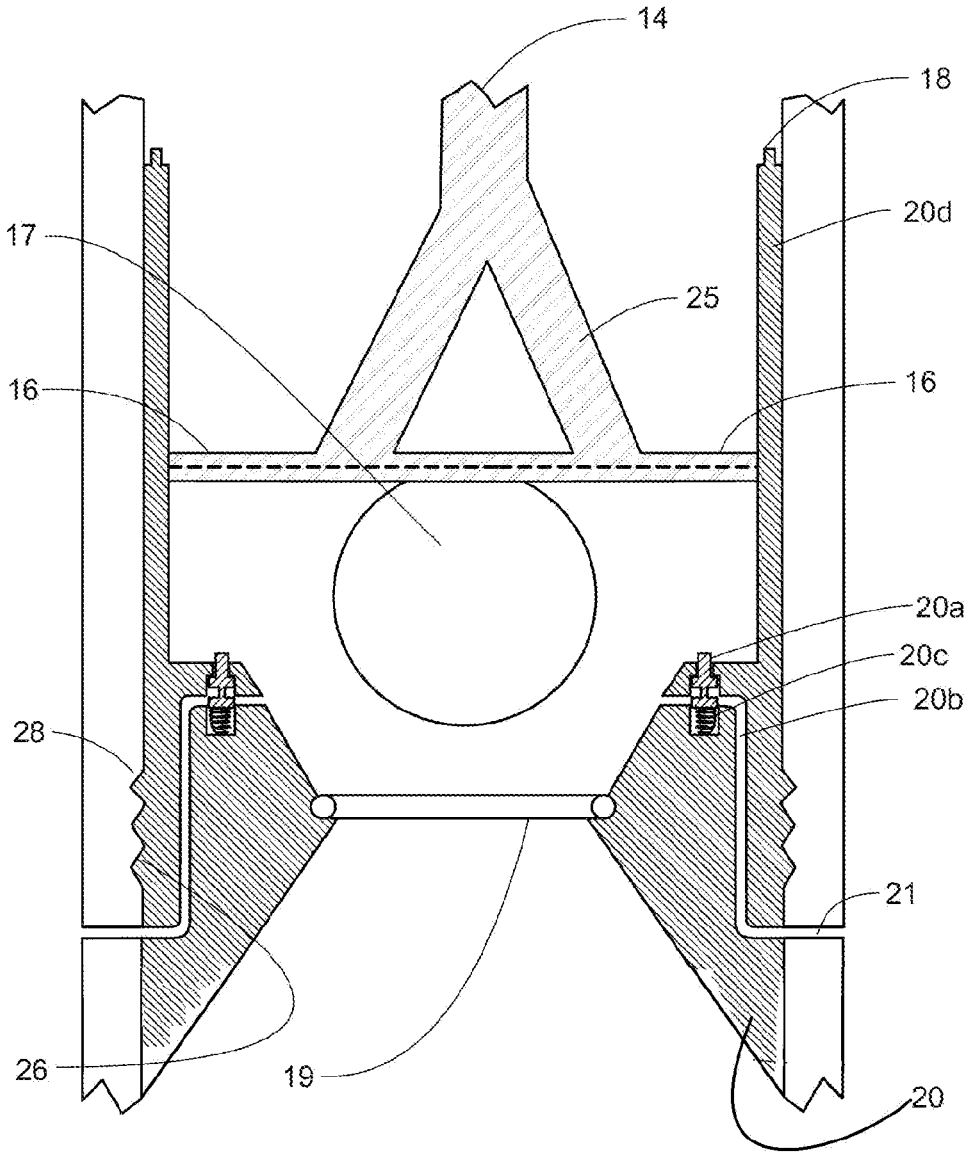
FIG. 2 depicts an exploded cross-sectional view of the bottom of the exemplary dry-barrel hydrant of FIG. 1A.
Figure 3:
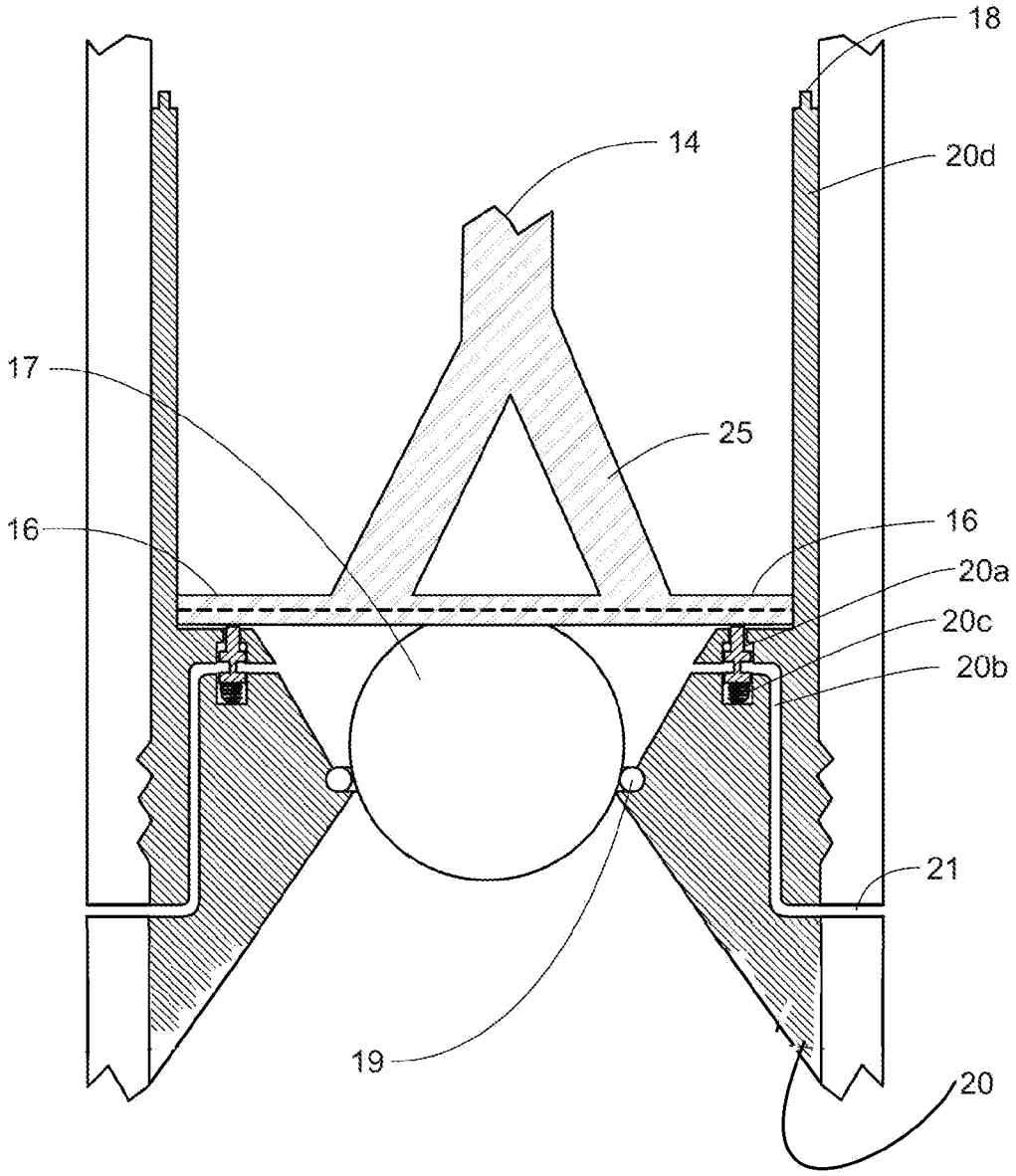
FIG. 3 depicts an exploded cross-sectional view of the bottom of the exemplary dry-barrel hydrant of FIG. 1B.
Figure 4:
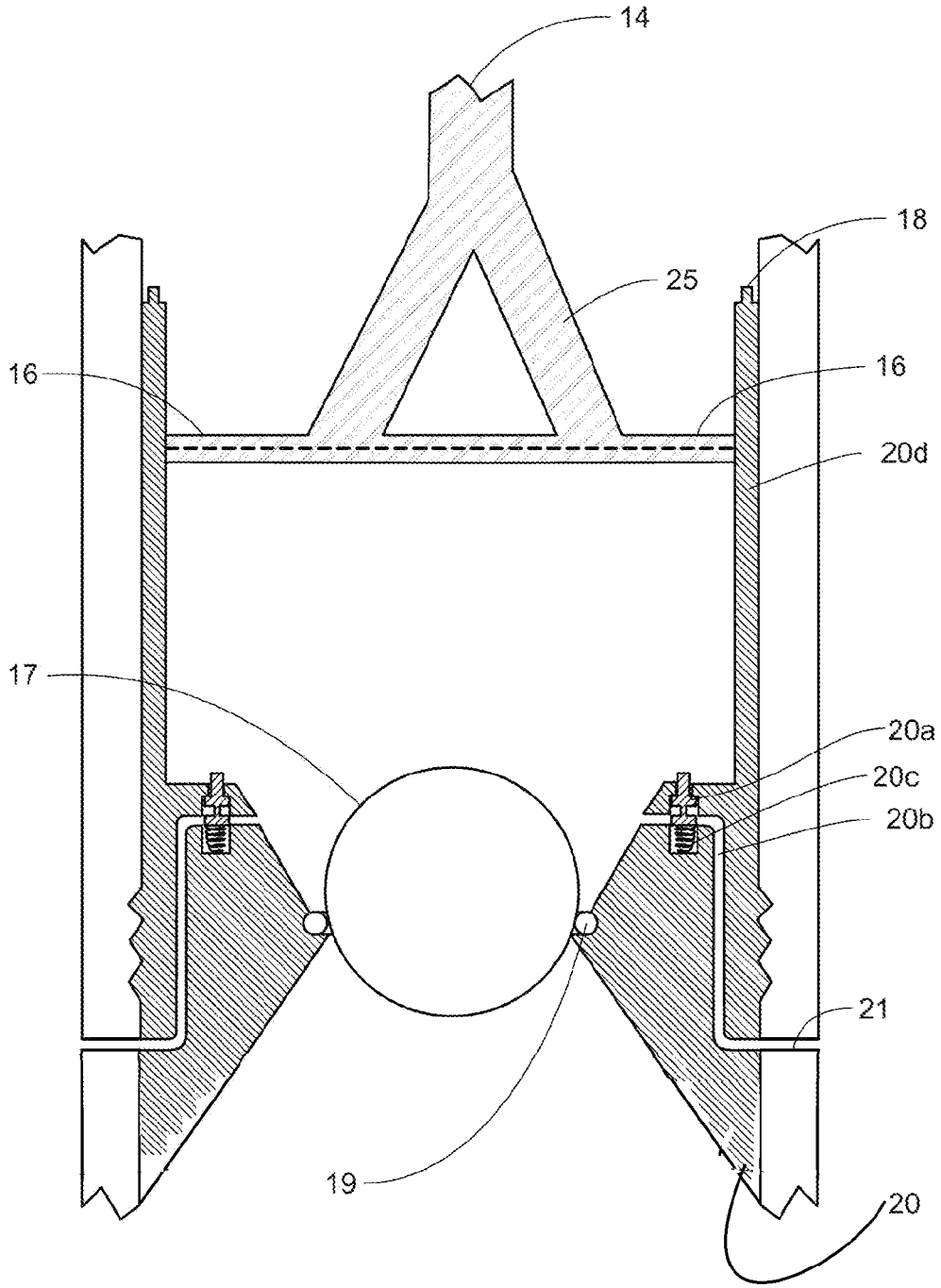
FIG. 4 depicts an exploded cross-sectional view of the bottom of the dry-barrel hydrant of FIG. 1C.

In exemplary embodiments of the present invention, such threading can be accomplished by connecting a spanner wrench or other appropriate tool to the upper posts or pins that protrude from the edge of an IFCBPV cylindrical housing sleeve extension. In exemplary embodiments of the present invention said pins can be placed parallel to the valve housing's longitudinal axis, and provided on the top of the valve housing (as seen in FIGS. 2-4, index number 18). Then, by simple rotation using such a spanner wrench, a user can remotely thread and secure the IFCBPV housing and optional integrated drain assemblies (for dry barrel hydrants) into the fire hydrant's lower inner barrel thread that heretofore received the "main valve seat ring." Such inner barrel threads are generally of the female type, so the IFCBPV housing can have, for example, a male threading on its outer lower perimeter. Other threading matings can be used, as may be needed to fit existing hydrants. In exemplary embodiments of the present invention, a cost-effective retrofit is thus offered that provides a valuable security and performance upgrade to existing hydrants.

Next described are various details of exemplary IFCBPVs according to exemplary embodiments of the present invention with reference to FIGS. 1-12.

Figure 1C:
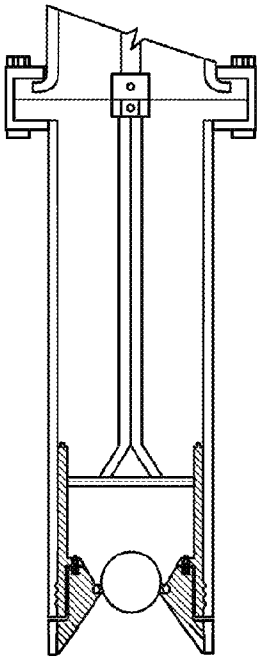
FIG. 1C depicts the main hydrant valve open, but subjected to a reversal in fluid differential pressure (i.e., potential backflow situation)
Figure 1B:
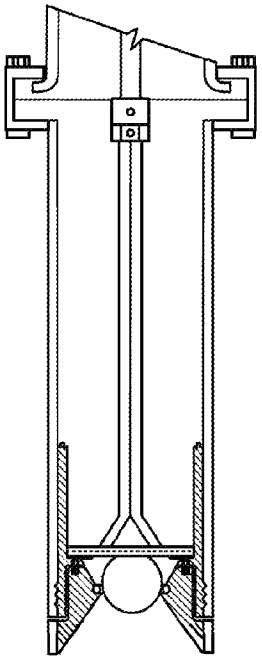
FIG. 1B depicts the main hydrant valve closed.
Figure 1A:
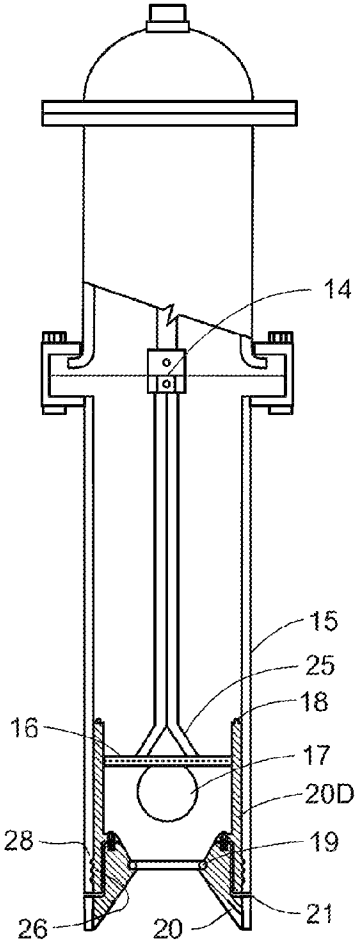
FIG. 1A depicts an exemplary main hydrant valve in the open position and subjected to normal (upward) flow.

FIG. 1 illustrates three cross-sectional views of an exemplary fire hydrant, in particular its bottom section 15, provided with an exemplary IFCBPV and hydrant dry-barrel drain assembly according to the present invention. In FIG. 1A the main hydrant valve is in the open position; in FIG. 1B, the main hydrant valve is in the closed position; and in FIG. 1C the main hydrant valve is open, but is subjected to a reverse differential pressure, or backflow, such that a freely suspended check ball seals in an exemplary seat.

Continuing with reference to FIG. 1, an exemplary hydrant can have the common breakaway upper housing assembly, and can have a conventional upper bonnet, and an axial stem 14. Axial stem 14 can, for example, be affixed to equidistant radially spaced flanges 25, which can be respectively connected to equidistant concave radial spokes that form ball retaining screen 16 (further details provided below, in the description of FIGS. 4 and 4A). In exemplary embodiments of the present invention, a freely suspended check ball 17 can be in direct communication with the concave underside of the tri-radial spoke retaining screen and central ring structure of retaining screen 16. The entire assembly can move longitudinally within the valve's cylindrical sleeve 20D. As shown in FIG. 2, there can be a vertical cylindrical sleeve extension 20*d* of the valve's cylindrical sleeve, and cylindrical sleeve extension 20*d* can, for example, have at least two upper posts 18 affixed thereto. The IFCBPV assembly's outer thread 26 can, for example, mate with a hydrant's existing lower barrel thread 28, which conventionally has a main valve "seat ring." Such cylindrical sleeve extension, posts and matable threading provide means for remote installation and removal of the IFCBPV assembly into existing—or new—hydrants. The IFCBPV can, for example, further be provided with one or more dry-barrel drain and valve assemblies in fluid communication with the hydrant's barrel drain hole(s) 21. Two exemplary types of such a dry-barrel drain are detailed below.

FIG. 1A depicts such an exemplary hydrant provided with an IFCBPV according to an exemplary embodiment of the present invention. Further details of the bottom portion 15 of the exemplary hydrant will next be described. The valve is open, and thus hydrant valve axial stem 14 has been rotated upwardly. The depicted situation is one of normal (upward) pressure and maximum flow, and thus freely suspended check ball 17 is forced by water supply pressure and resulting upwards flow towards the bottom of retaining screen 16, which holds it in place during such flow. Retaining screen 16 can have, for example, a concave tri-radial spoke and axial hub structure (described below), where the spokes meet in a central ring. As noted, axial stem 14 is connected to the upper portion of retaining screen 16 by flanges 25, here, for example, three flanges. Alternate exemplary embodiments can have, for example, more spokes, or even only two spokes, for example, in such retaining screen, and a corresponding number of flanges 25 connected to them and to axial stem 14, or other attachment means that allow free flow of fluid through the retaining screen. In the situation of FIG. 1A the dry-barrel drain valve assembly is closed, and no fluid path exists through barrel drains 21.

In exemplary embodiments of the present invention, freely suspended check ball 17 can be made to have a specific weight essentially equal to that of the surrounding fluid, here, for example, water, or, for example, slightly greater than such surrounding fluid. This effectively eliminates gravitational effects (including buoyancy) on its position relative to the surrounding fluid, and thus it will move either by fluid flow (in whichever direction) or by manually constricting it in a closed position. In exemplary embodiments of the present invention, freely suspended check ball 17 can be made of a non-porous material, such as thermoplastic or metal.

FIG. 1B depicts the hydrant of FIG. 1A with the exemplary IFCBPV valve in the closed position. FIG. 3 is a magnified view of the lower portion of FIG. 1B. Here, axial stem 14 has been moved downwards, forcing the bottom of the retaining screen to be in compressive contact with the top of ball 17, and the bottom of freely suspended check ball 17 to be in compressive contact with a sealable lower ball seat, "O" ring 19, the latter of which can be provided, for example, as depicted, in a structural groove in main valve housing 20 rendering it immobile The bottom of ball 17 and "O" ring 19 thus form a hydraulic seal, thereby precluding all flow. Simultaneously, as shown in FIG. 3, the outer perimeter of retaining screen 16, being in compressive contact with the exposed upper post of hour-glass shaped piston 20*a* and spring 20*c* (see FIG. 2), forces piston 20*a* downward by compressing spring 20*c*. This action opens the dry-barrel drain valve, and as a result, any water trapped in the upper and lower barrel sections of the dry-barrel hydrant can drain through the drain valve 20*b* to outer drain hole 21 and out into the surrounding soil. Piston 20*a*, optionally, can have a self-lubricating and self-sealing surface coating.

FIG. 1C depicts the hydrant of FIGS. 1A and 1B where the exemplary IFCBPV is open, as in FIG. 1A, except that now the hydrant is subjected to a potentially hazardous reversal in fluid differential pressure, i.e., a backflow condition. FIG. 4 is a magnified view of the lower portion of FIG. 1C. Thus, freely suspended check ball 17, having a specific weight essentially equal to or slightly greater than the specific weight of the fluid, and thus not substantially buoyant, is instantly forced downward. Fluid flow ceases as soon as freely suspended check ball 17 is in compressive contact with "O" ring 19, just as in the case depicted in FIG. 3. However, in the situation of FIG. 4 it is the backflow, as opposed to hydrant valve axial stem 14 (as in the case of FIG. 3), that supplies the downward force. Because the IFCBPV is open, retaining screen 16 is not in contact with piston 20*a*, and the dry-barrel drains remain closed.

As noted, FIG. 2 illustrates an exemplary exploded cross-sectional view of FIG. 1A, showing the insert containing the IFCBPV and barrel drains as inserted into a conventional hydrant (the insert comprises everything within the grey shading), where the IFCBPV is open and subjected to normal forward flow. Main valve housing 20 has, for example, an external thread 26 which can thus mate with the hydrant's existing lower thread 28, for a dry-barrel hydrant. As noted, an exemplary IFCBPV can, for example, have a cylindrical sleeve extension 20*d* and upper posts 18 (means for remote valve installation and removal) affixed thereto. Based on physical symmetry and well-established fluid kinetics principles, freely suspended check ball 17 is thus in perfect alignment, and in essentially compressive contact, with movable concave tri-radial spoke retaining screen 16, having a central (hollow) ring structure. In exemplary embodiments of the present invention ball 17 does not actually touch the bottom of retaining screen 16, but rides on a film or thin layer of the surrounding fluid, due to the unique concave spoke design, as described below with reference to FIGS. 4 and 4A. In exemplary embodiments of the present invention, on its upper portion, retaining screen 16 can be mechanically affixed to, for example, three flanges 25 that are connected to the hydrant's axial stem 14 and breakaway assembly (upper axial coupling that breaks away when the upper barrel of the hydrant is struck by a vehicle), which move vertically within the IFCBPV's cylindrical sleeve 20*d*. Also illustrated in FIG. 2 are dry-barrel drain valve components 20*a*, 20*b*, 20*c* to drain the hydrant's upper and lower barrel. The dry-barrel drain components can be integrated within main valve housing 20, as shown, and conveniently mate or line up with a conventional outflow port 21. Such drain components can comprise, for example, a piston chamber having a movable hour glass shaped piston 20*a* with an upper post, a drain line 20*b*, and a piston spring 20*c*. The exemplary dry-barrel drain valve is here shown in the closed position, because the IFCBPV is open, as described above.

FIG. 3 illustrates the bottom of the exemplary dry-barrel hydrant valve of FIG. 2 where the IFCBPV is closed, as a result of a user having turned the hydrant's axial stem 14 downward, thereby forcing freely suspended check ball 17 downward against the normal flow so as to seal in compressive contact with a sealable lower ball seat, sealing "O" ring 19. As noted, "O" ring 19 can be affixed in a groove within a truncated cone of the main valve housing 20, as shown here in detail.

Simultaneously, as a result of this closed position of the IFCBPV, the barrel drain valve is now open, as the underside of the outer ring of retaining screen 16 is in compressive contact with the exposed upper post of piston 20*a*, compressing piston 20*a* and thus piston spring 20*c* downward, and thus repositioning hour-glass shaped piston 20*a* so as to open a flow path through drain line 20*b*. Now that dry-barrel drain valve(s) is/are open, each can drain the hydrant's upper and lower barrel. As noted, the entire barrel drain and valve assembly can be housed within the IFCBPV housing so as to interoperate with the hydrant's outer drain hole(s) 21.

In exemplary embodiments of the present invention, when the hydrant is closed or for reverse flow, the sealable lower ball seat (also referred to as the "valve seat") annulus can have, for example, a circular flat surface that is inclined to the longitudinal axis, forming a surface that resembles a truncated cone. Therein can be a groove that houses an O-ring to ensure sealability when the hydrant is closed or in a backflow condition.

FIG. 4 depicts an exemplary cross-sectional exploded view of the bottom of FIG. 1C, which, as noted, shows a backflow condition. At the top of FIG. 4 is shown the hydrant's axial stem 14 to which are affixed flanges 25. Flanges 25 in turn are affixed to spokes of the retaining screen 16, as noted. Freely suspended check ball 17 is seated, in compressive contact with "O" ring 19, as described above. Additionally, dry-barrel hydrant drain valve(s) is/are closed, and thus each outer drain hole 21 is sealed off from the fire hydrant barrel that is now being subjected to a hydraulic and potentially hazardous flow reversal (backflow). Because of the backflow, as noted above, ball 17 is pushed downward, so as to be seated in compressive contact with "O" ring 19. This seals off the normally open orifice, and thus terminates flow, preventing the backflow condition from pushing fluid downwards, out of the hydrant, and into the water supply.

Figure 4A:
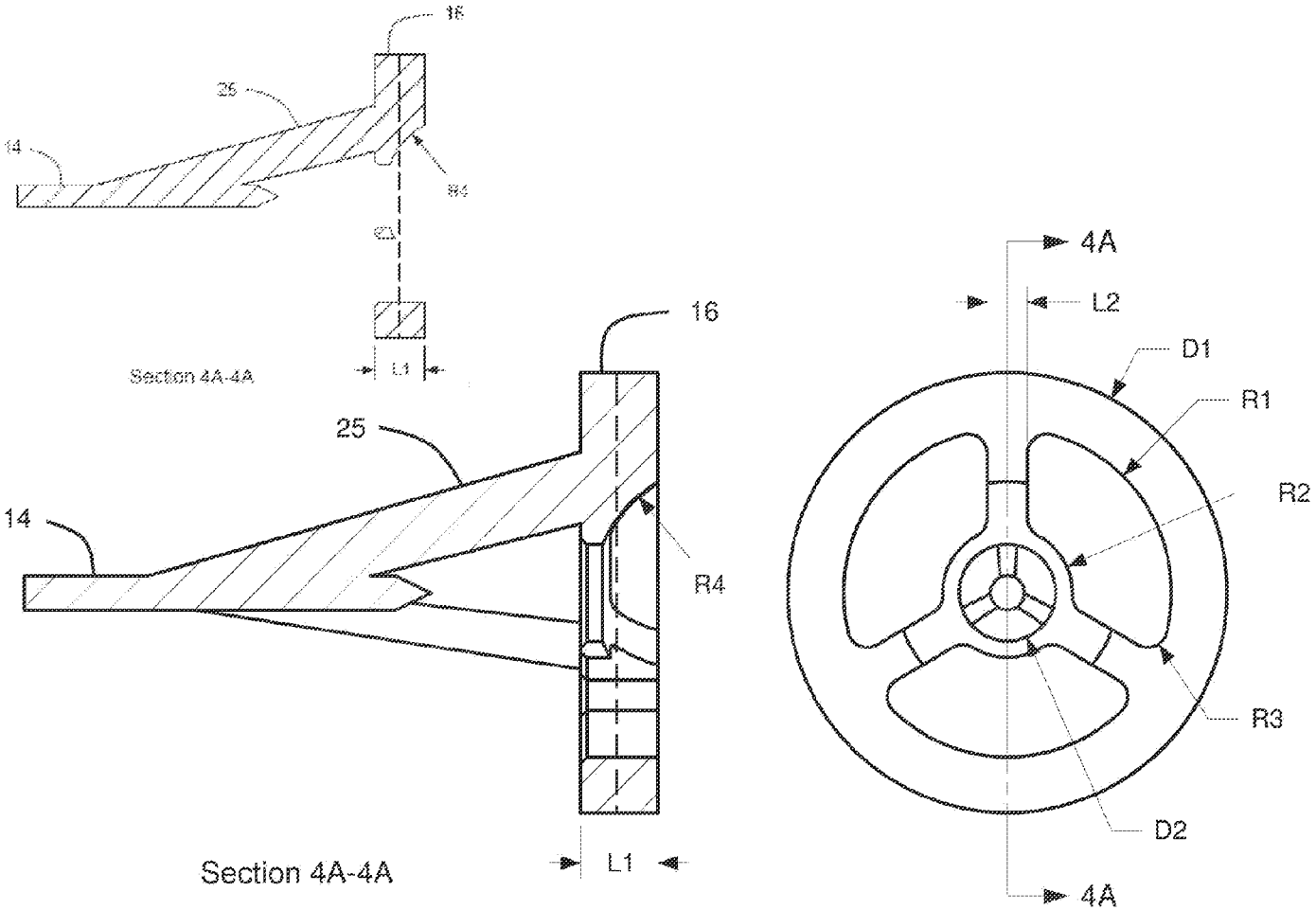
FIG. 4A (left image) depicts an exemplary cross-sectional view of an exemplary axial stem together with connecting flanges respectively affixed between said stem and two of the spokes of an exemplary retaining screen (also shown is a 2D section slice perpendicular to the plane of the page through the line 4A-4A shown in FIG. 4A (right image))
Figure 4B:
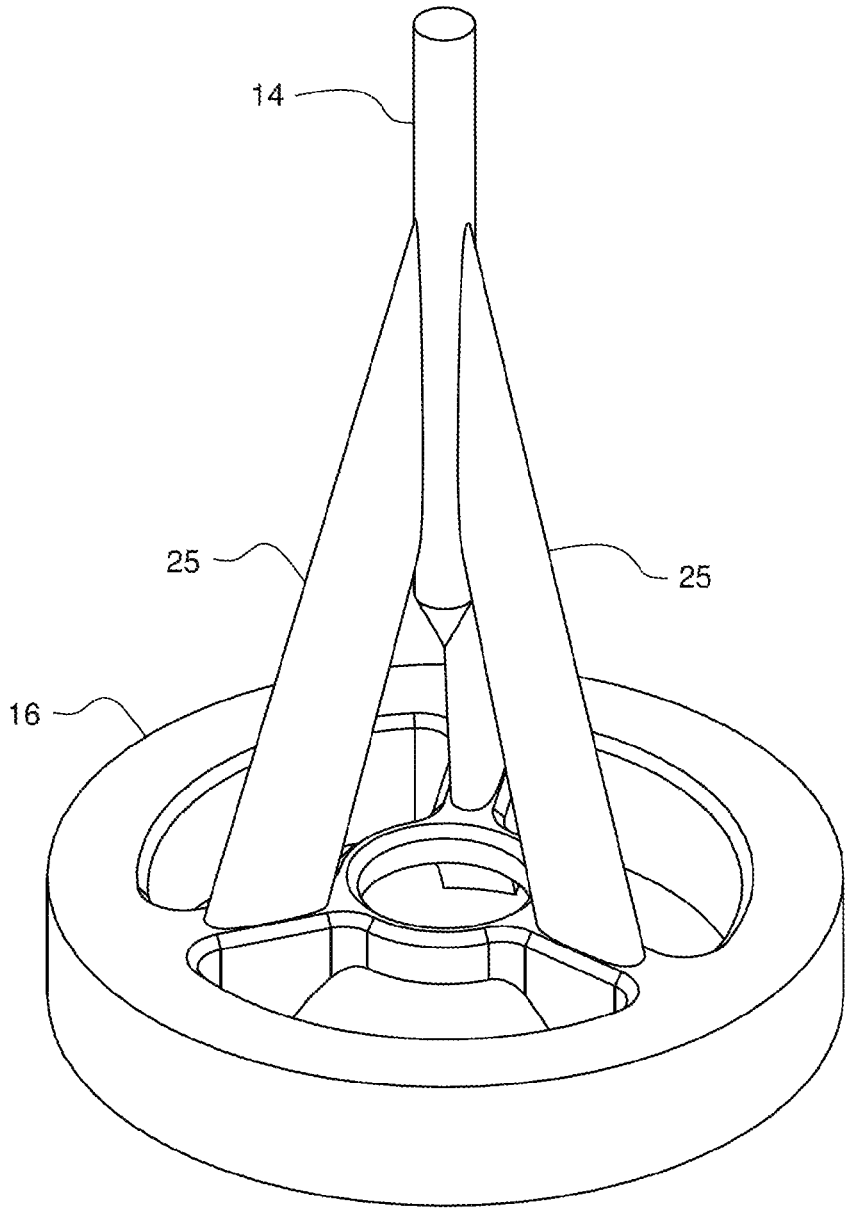
FIG. 4B depicts an exemplary isometric view of the exemplary axial stem, connecting flanges and down stream (flat) side of the exemplary retaining screen (tri-radial spokes and central ring structure) of FIG. 4A.

FIGS. 4A-4B depict details of the retaining screen structure. In exemplary embodiments of the present invention, retaining screen 16 can, for example, have three equidistant concave radial spokes which intersect at a central axial ring structure. The radial spokes can, for example, be separated by three equally spaced portholes, and thus fluid can flow through the retaining screen via either the portholes between its spokes or the central hollow of the central ring structure. In exemplary embodiments of the present invention the diameter of the bottom of retaining screen 16 can, for example, be made slightly larger than the diameter of a desired ball 17. By way of example, the lower side of the retaining screen can form a 4 inch diameter ball seat that can, for example, accommodate a ball that is approximately 3.8 inches in diameter. This insures that a thin layer of water can be directed by the concave radial spokes comprising the "basket" of the underside of retaining screen 16, and that the ball 17 can thus essentially ride on such layer of fluid, which provides a self cleaning feature, as well as minimizes contact with the hard surface of the underside of retaining screen 16, minimizing wear of ball 17 under forward flow.

FIG. 4A (left image) depicts an exemplary cross-sectional view taken along the line 4A-4A in FIG. 4A (right image) of the retaining screen assembly. The view is oriented such that a viewer is looking towards the plane perpendicular to the page and containing line 4A-4A, viewpoint to the left of line 4A-4A. The shaded regions in such left image correspond to a 2D slice through the assembly along the line 4A-4A, and for ease of illustration, such 2D slice is also provided above the left image as well. The non-shaded regions in the left image show the structures "behind" such slice at 4A-4A, as seen from the viewpoint described above. Visible is axial stem 14 and two of the three flanges 25 affixed thereto, which are connected to the upper portions of two of the three concave radial spokes of retaining screen 16.

FIG. 4A (right image) shows a cross-sectional view of the bottom of retaining screen 16, from the vantage point of a person looking upstream from underneath said retaining screen. Visible here is the ball seat comprising the central ring structure and three equidistant concave radial spokes of the retaining screen. Through the center of the ring structure can be seen the three flanges 25 meeting at axial stem 14. Exemplary dimensions are shown, namely L2, the width of the spokes, R1, the radius from the center of the ring structure to the inner ring (end of the porthole) of the outer ring of the retaining screen. R2, the radius from the center of the ring structure to the outer edge of the central ring structure, D1, the overall diameter of the retaining screen, and D2 the inner diameter of the central ring structure (which is the opening through which fluid flow lines redirected by the concave spokes move in forward flow). R4 in the left image is the radius of curvature of the concave retaining screen spokes, which, as noted, can be made slightly larger than the radius of the ball, so as to provide for the layer of fluid on which the ball "rides" in forward flow, and similarly, L1 is the vertical thickness of the spokes at their full untapered shape, in the outer ring of retaining screen 16.

FIG. 4B depicts an exemplary isometric view of axial stem 14 together with the three flanges 25 affixed thereto and respectively connected to the upper portion (downstream side) of the three radial spokes of retaining screen 16.

Figure 5:
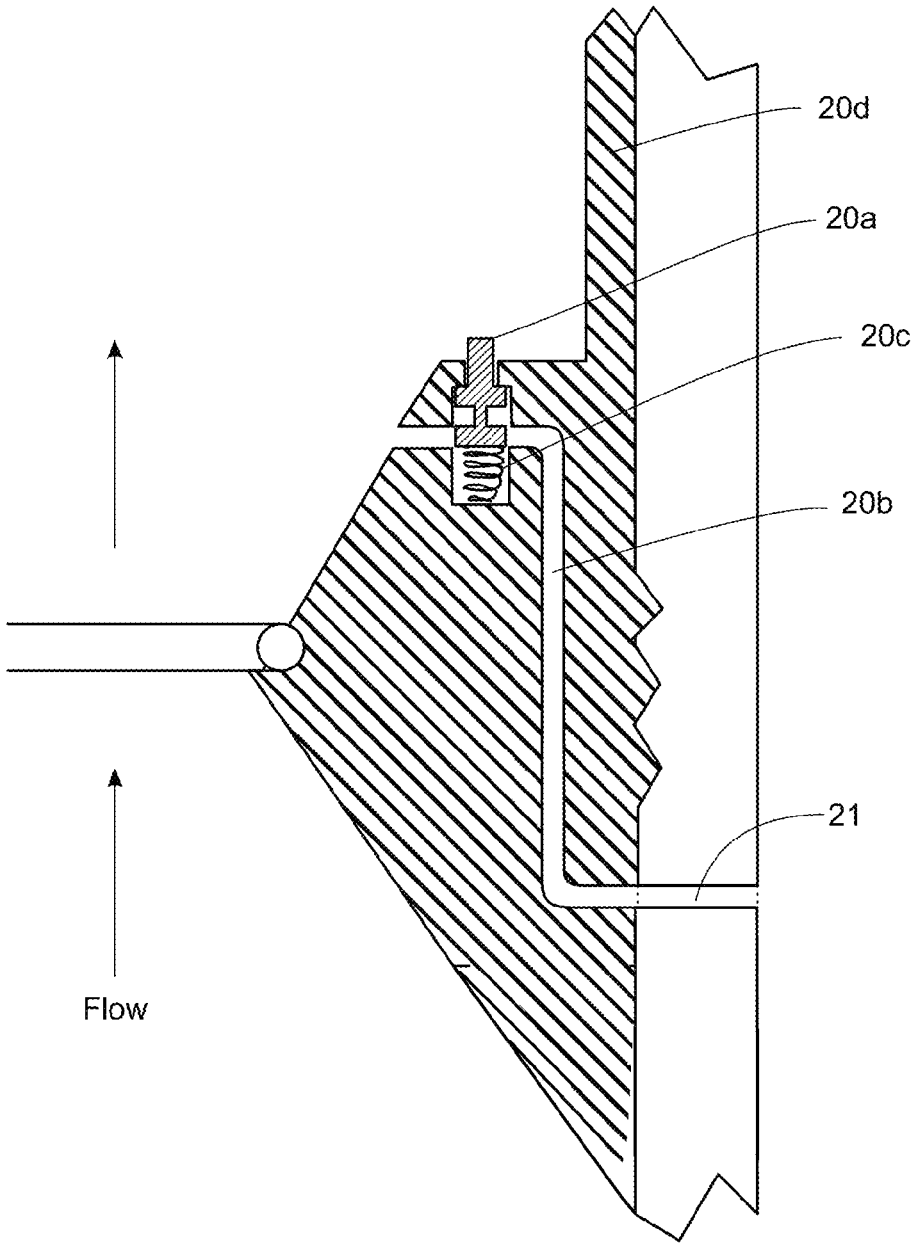
FIG. 5 depicts a partially exploded cross-sectional view of an exemplary insertable flow control backflow preventer valve with integrated drain barrel valves at the bottom of a dry-barrel hydrant according to an exemplary embodiment of the present invention, hydrant valve in the fully open position and subjected to normal flow, thus drain valve is closed.
Figure 6:
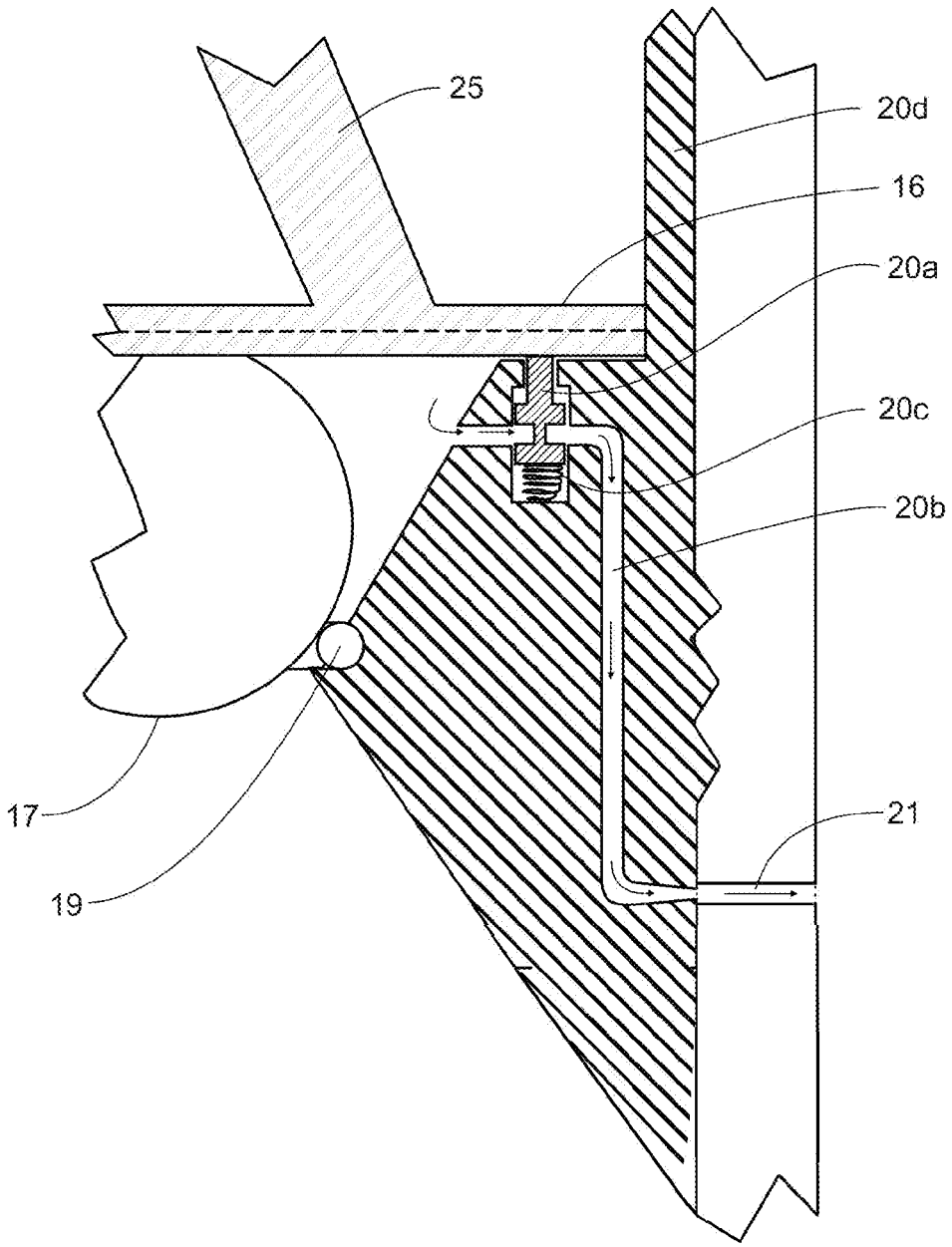
FIG. 6 depicts a partially exploded cross-sectional view of the exemplary valve of FIG. 5 with hydrant valve in a closed configuration, thus drain valve is opened.

FIG. 5 depicts a partial magnified view of one side of the bottom of the exemplary IFCBPV of FIG. 2, with main valve 20 open, under normal flow. The integrated dry-barrel hydrant drain valve is in the fully closed position, and thus spring 20*c* fully extended, and piston 20*a* cuts off drain line 20*b*. As can be seen, the shape of piston 20*a* is designed to close off the barrel drain when the spring is fully extended, but allow flow around its central shaft when the spring is fully compressed, as shown in FIG. 6. In exemplary embodiments of the present invention, inlet and outlet orifices of barrel drain line 20*b* can, for example, be made slightly smaller in diameter than the remaining segment of the drain line. This can, for example, screen out larger solids that can otherwise clog a dry-hydrant barrel drain assembly. Because here barrel drain is fully closed, lower outer barrel drain port hole 21 is sealed off from the water flowing inside the barrel of the fire hydrant.

FIG. 6 depicts a partial exploded view of one side of the bottom of the exemplary IFCBPV of FIG. 3, with main valve 20 closed. Now piston 20*a* is pushed down by retaining screen 16 so that spring 20*c* is fully compressed, and thus the barrel drain valve is open, allowing the upper and lower sections of the dry-barrel hydrant to drain through the drain valve assembly and outlet orifice 20*b*, and discharge through hydrant outlet port 21. As noted, in this main valve closed position, (i) retaining screen 16 causes freely suspended check ball 17 to be in compressive contact with "O" Ring 19 creating a hydraulic seal, which terminates all flow, either up or down, in the fire hydrant barrel housing, and simultaneously, (ii) retaining screen 16 forces the protruding post of the dry-barrel drain valve piston 20*a* downward, thereby opening the dry barrel drain valve assembly.

Figure 7:
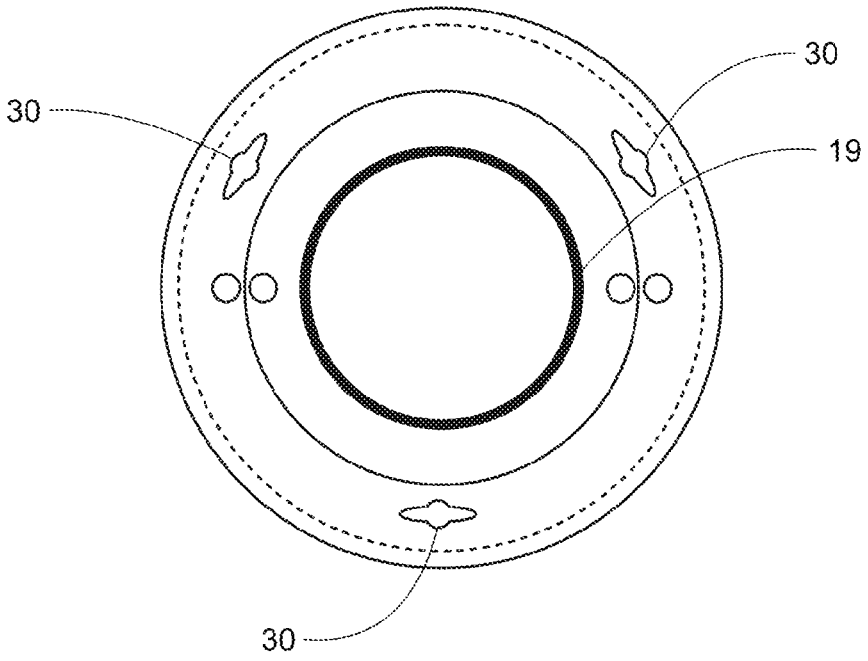
FIG. 7 depicts a top view of an exemplary hydrant valve for either dry or wet type hydrants with key slots (means for remote valve installation and removal) according to an exemplary embodiment of the present invention.

FIG. 7 depicts a top view (viewpoint above the hydrant barrel) of an exemplary IFCBPV for either dry or wet type hydrants having an exemplary set of key slots 30 (alternate means for remote valve installation and removal). In exemplary embodiments of the present invention, for wet barrel hydrants, in lieu of a cylindrical sleeve extension and upper posts affixed thereto as described above, a wet-barrel hydrant drain and valve assembly can, for example, be provided inside the valve housing of the IFCBPV. FIG. 7 also shows "O" ring 19 located in the valve's sealable lower ball seat, which can be used, for example, for all types of hydrants—providing means for terminating flow in the event of a reverse in pressure, as noted above.

Figure 8:
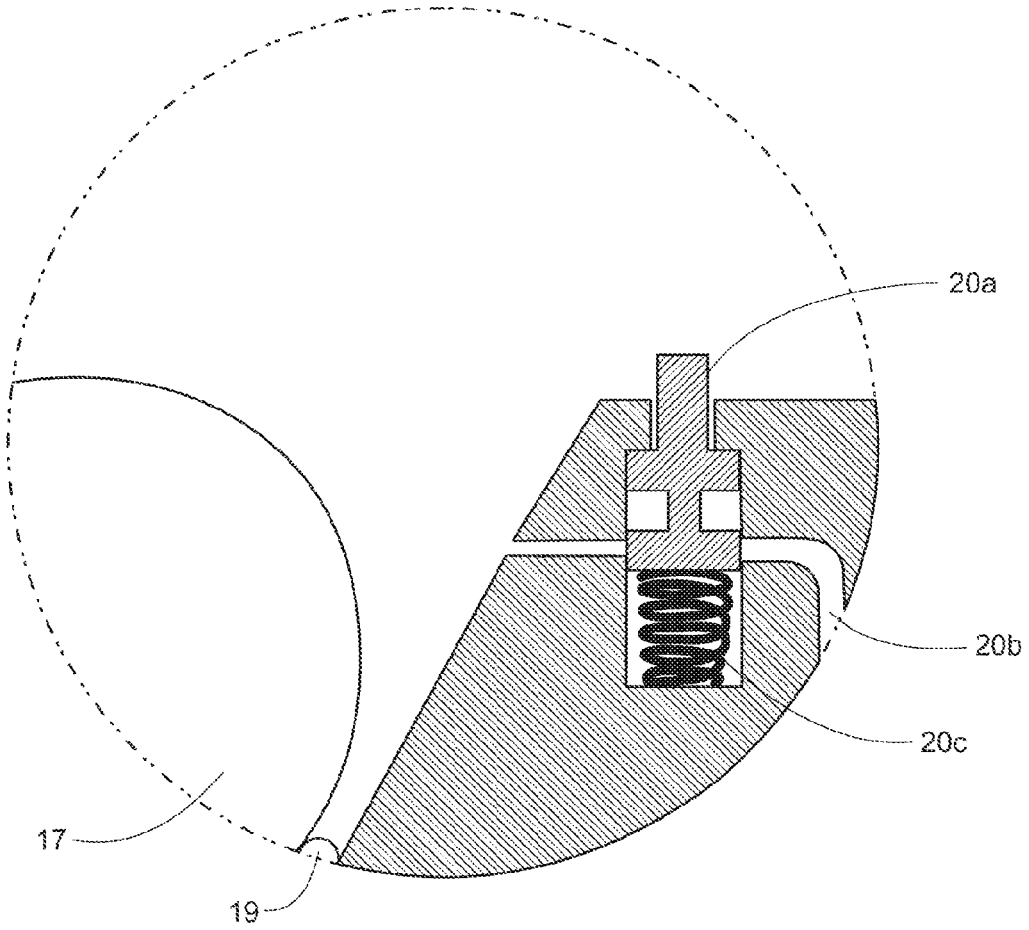
FIG. 8 depicts a cross-sectional exploded view of the exemplary barrel drain assembly shown in FIGS. 2-4.

FIG. 8 depicts detail of the dry-barrel drain valve assembly, in the situation depicted in FIG. 4, where the main valve closed due to backflow condition, and barrel drain valve also closed to cut off any flow path to/from outside of the hydrant. Visible are ball 17 seated in "O" ring 19, and piston 20*a* in closed position due to full extension of spring 20*c*. Also visible is drain line orifice inlet smaller in relative size to the rest of drain line 20*b* to screen out larger solids that can otherwise clog a dry-hydrant barrel drain assembly.

Figure 9:
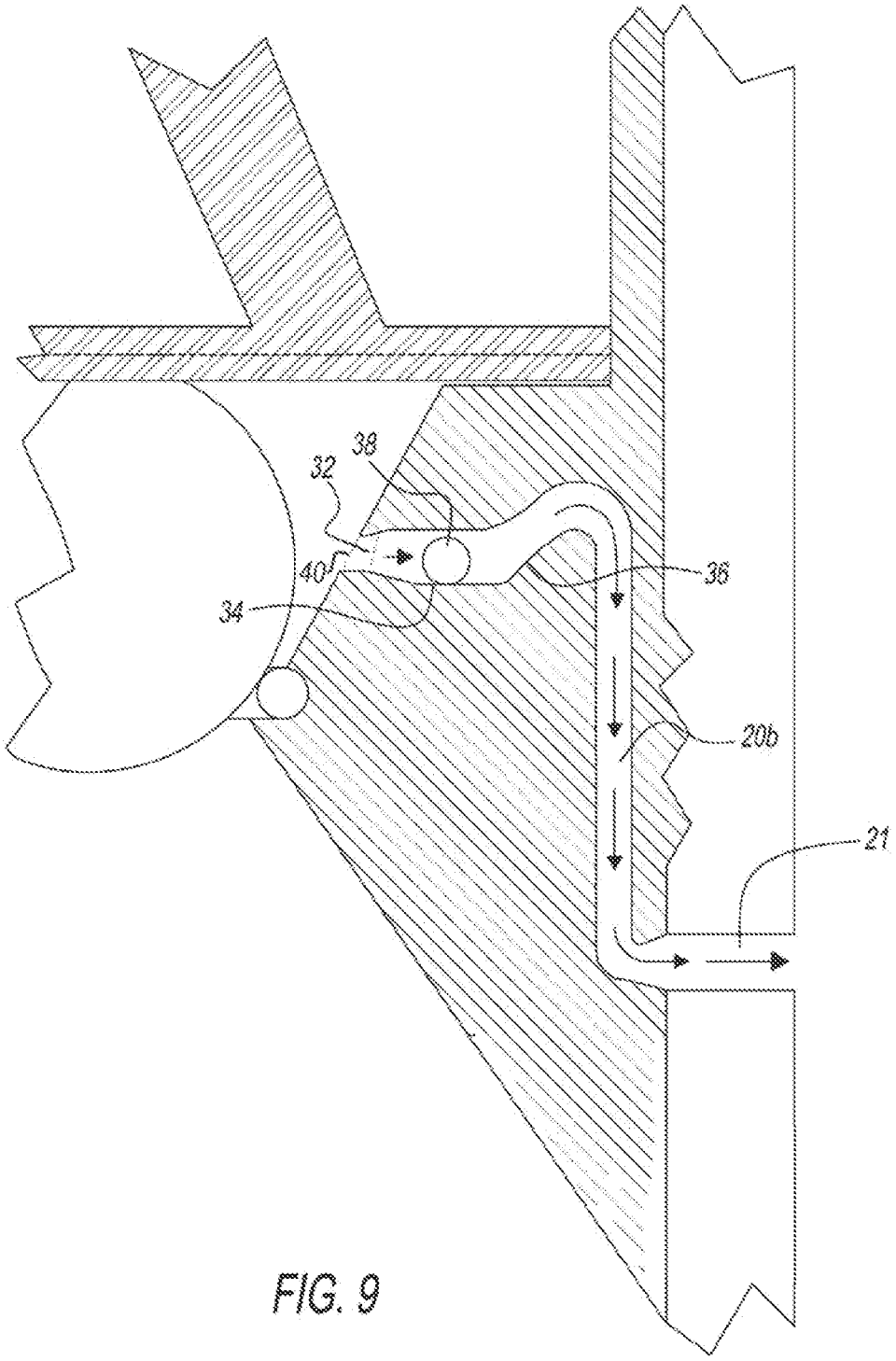
FIG. 9 depicts a cross-sectional exploded view of an alternative exemplary barrel drain assembly which uses a freely suspended check ball in a special chamber, rather than a spring and piston, in an open configuration (hydrant valve closed)
Figure 10:
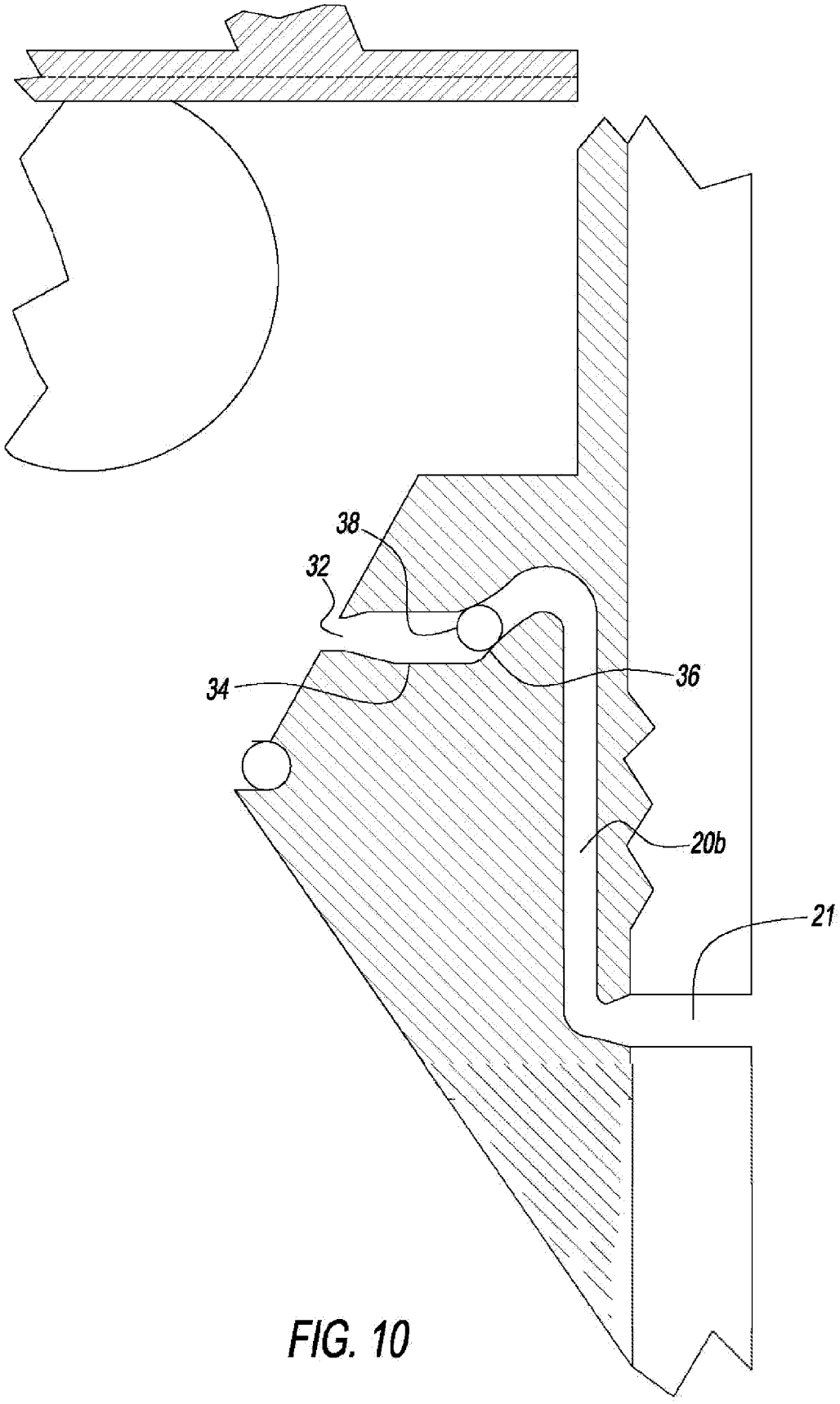
FIG. 10 depicts a cross-sectional exploded view of the alternative exemplary barrel drain assembly of FIG. 9 in a closed position (hydrant valve open)
Figure 11:
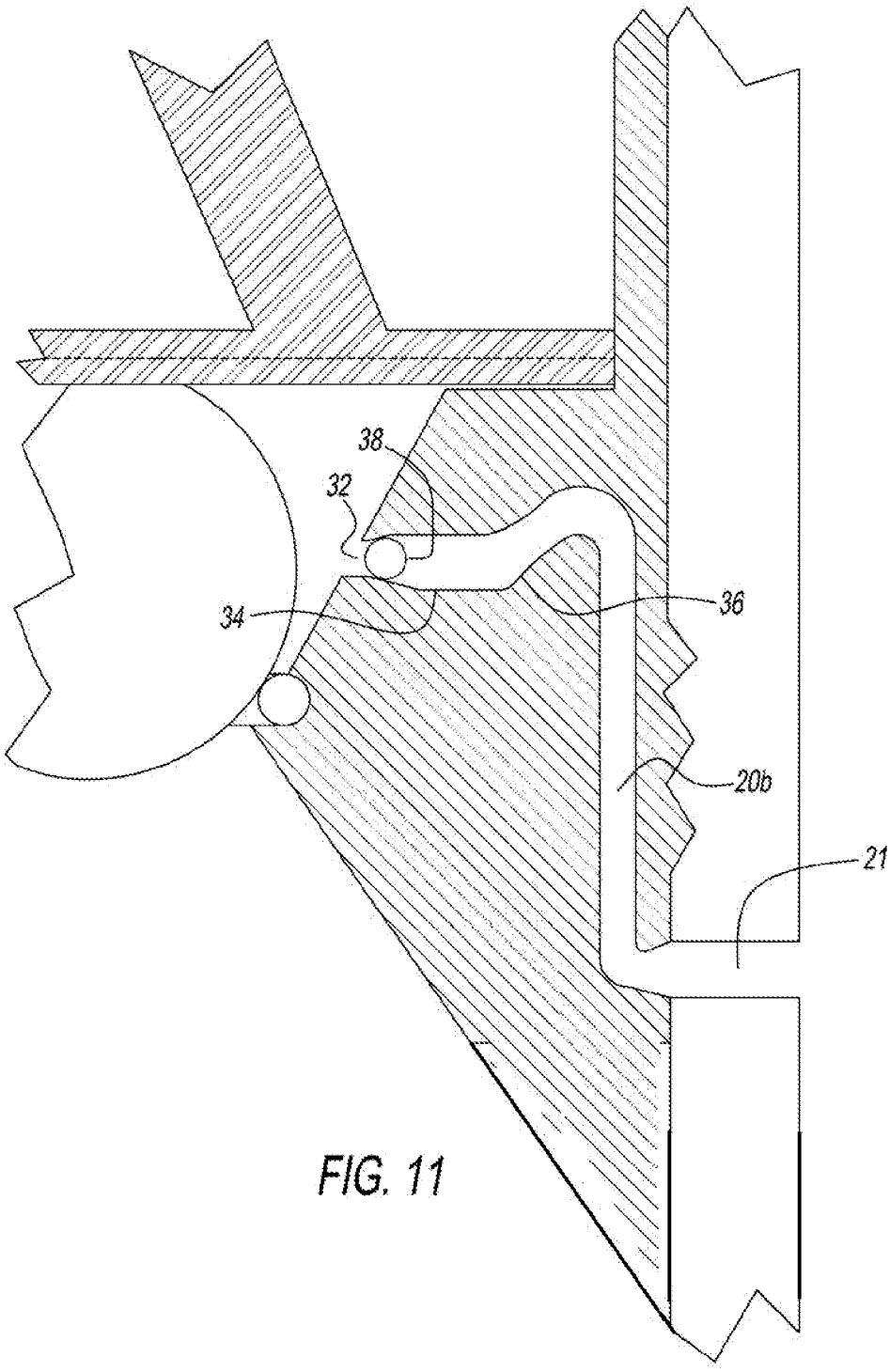
FIG. 11 depicts a cross-sectional exploded view of the alternative exemplary barrel drain assembly with the main hydrant valve closed as in FIG. 9 but a backflow condition prevailing in the drain line.

FIGS. 9-11, next described, depict cross-sectional exploded views of an alternate exemplary embodiment of the present invention, having a simplified barrel drain system. This alternate barrel drain system has a single moving part, a barrel drain ball. The barrel drain ball is actuated solely by gravity and fluid pressure, and thus no mechanism is required to mechanically link it to the closure of the main hydrant valve, as is described above in connection with piston 20*a* of FIGS. 2-4.

FIG. 9 depicts an exemplary hydrant in a closed position, where no normal flow of water occurs, analogous to the situation of FIG. 3. Thus, the drain valve is at most subjected to the pressure associated with a full column of water remaining inside the upper barrel of the hydrant after it has been used, or a maximum hydrostatic pressure of less than or equal to 12 PSI. Details of this drain system are next described.

With reference to FIG. 9 there can be seen a drain line orifice inlet 40 provided in the wall of the lower barrel chamber cavity. This orifice leads to a drain line, which runs through the IFCBPV insert and connects to outer port 21 of the hydrant. Within the drain line is provided ball 38, which has a check-valve functionality, as described below. Ball 38 has three "seats" or positions within the drain line which it can assume under various flow conditions. The first is an "upstream" ball seat 32, as shown, very close to orifice 40. It is noted that orifice 40 is smaller in relative size to the rest of the drain line and even to the diameter of the drain line at upstream ball seat 32. The smaller inlet diameter of orifice 40 is intentionally selected to screen out larger solids that can otherwise clog a dry hydrant barrel drain assembly. The next smaller diameter, that at upstream ball seat 32 and downstream ball seat 36, is chosen to have an inner diameter that is smaller than the outer diameter of ball 38, so that ball 38 naturally seals there during a drain line backflow position, as described below. Also shown in FIG. 9 is a horizontal segment 34 of the drain line. It is here that ball 38 normally seats when the hydrant is closed, and when the column of water drains from the hydrant after the hydrant is first closed. In exemplary embodiments of the present invention, ball 38 can have a specific weight greater than 1.0, and is thus affected by gravitational forces. It can have, for example, a specific weight of from 1.5 to 3.0 in various exemplary embodiments, or other values as may be desired to preserve its key functionality. This key functionality is that it be (i) sufficiently relatively heavier than the surrounding fluid so as to be operated upon by a gravitational force, and at the same time (ii) not so much heavier than the surrounding fluid such that it cannot be moved under normal fluid pressures of 60-150 PSI when the hydrant is open, and fluid flows normally.

As noted, under normal conditions, ball 38 is seated in horizontal drain line segment 34, as shown in FIG. 9, in its "normal" position. Also visible is the third and final ball seat, a "downstream" ball seat 36 pitched at an acute upward angle with horizontal drain line 34, for example, approximately 45 degrees. This is described in connection with FIG. 10 below. To the right of upstream ball seat 36 is the remainder of the drainage line, i.e., vertical drain line segment 20*b* that continues to and connects with outer port 21, which is standard in any conventional hydrant.

In the configuration of FIG. 9, when the hydrant is closed, but still full of water from a prior use, the extremely low hydrant pressure associated with the approximately 5 feet of water in the hydrant's upper barrel, i.e., between the hydrant's discharge nozzles and its main valve seat ring, has no measurable impact on ball 38, and cannot move ball 38 from its normal ball seat (which is between ball seats 32 and 36 such that water can pass by it) within horizontal segment 34. Water inside the upper barrel of the hydrant thus flows freely into orifice 40, past upstream ball seat 32, through horizontal segment 34 and past ball 38, through downstream ball seat 36 and on through vertical drain line segment 20*b* and ultimately out of the drain valve through port hole drain 21.

When the hydrant is initially opened the entire drain assembly is open (ball 38 is in said "normal" ball seat) water flows instantaneously and rapidly. In exemplary embodiments of the present invention, such a combination of features allows a hydrant to, for example, momentarily flush out any solids (smaller than the drain line inlet and outlet) that may be in the barrel drain line to the external soil environment. The barrel drain line is then instantly sealed when the main hydrant valve is partially or totally opened, as ball 38 is forced into downstream ball seat 36 by the much greater pressure of normal hydrant flow (as compared to the pressure associated with the column of water that extends from the hydrant's seat ring to its discharge nozzles when the hydrant is closed, which is insufficient to move ball 38). When the hydrant is in use and the valve is fully open, the dry-barrel drain(s) are thus closed by ball 38 seated at ball seat 36, thereby preventing any flow or leakage that could otherwise scour the external soil or fill material that holds the hydrant securely in place, and compromise the structural integrity of the hydrant.

FIG. 10 depicts a cross-sectional exploded view of the hydrant of FIG. 9, with the main hydrant valve either partially or completely open, and normal flow occurring. Here the drain assembly is subjected to elevated hydraulic pressure, and flow is prevented in the drain line by ball 38 seating at upstream ball seat 36 as described above. In this configuration, ball 38, which has specific weight greater than 1.0 is forced by the now prevailing system water supply pressure, (for example 60-150 PSI), into the downstream ball seat 36, terminating all flow.

FIG. 11 depicts a cross-sectional exploded view of the hydrant of FIG. 9 when a backflow condition prevails in the drain line. Here ball 38, under the fluid pressure introduced from the outside through port hole drain 21, moves leftwards, and seats at its upstream ball seat 32, thus closing off the drain line from fluid communication with the main barrel cavity. Thus, if a saboteur, or an accidental flood, for example, were to change the pressure applied at porthole drain 21, none of the outside fluid could enter the hydrant's main cavity.

It is noted that when a backflow condition prevails in the main hydrant valve, it must be the case that the backpressure associated with the contaminant exceeds that of the normal supply system. Thus, the backpressure is sufficient to force ball 38 into ball seat 36 and prevent the contaminant from entering the surrounding soil.

Thus, the exemplary IFCBPV of FIGS. 9-11 has double backflow prevention, with essentially two moving parts—two very durable spheres, with no sharp edges—providing long standing durability, and essentially no maintenance. Upstream ball seat 32 provides backflow protection in the event of flow reversal in the drain line, i.e., backflow from surrounding soil water or intentional system contamination by a saboteur, and downstream ball seat 36 insures that when the hydrant is being used, all the water goes out the hose, and none out of the barrel drain line into the soil that could compromise the structural stability of the entire hydrant assembly. Thus, ball 38 moves within horizontal segment 34 and stops on either end, at ball seats 32 and 36. As can be seen in the figures, ball seats 32 and 36 are each slightly higher than the level of horizontal segment 34, which slopes upwards at each end, thus requiring that the forward flow (FIG. 10), or the drain line backflow (FIG. 11), be sufficient to push ball 38 upwards a short distance, against gravity, in order to seat it and close the drain line.

An example barrel drain system such as shown in FIGS. 9-11 can have ball 38 made out of choice steel, for example, which has excellent durability and hardness. For example, drain line 34 can have a 0.4375 inch internal diameter, ball 38 can have a 0.1875 inch outside diameter, and ball seats 32 and 36 can have a 0.125 inch internal diameter and can be positioned as indicated in FIGS. 9-10. All of these dimensions can be scaled as desired. Again, when the main hydrant valve is closed after use, and thus the water pressure inside the upper barrel of the hydrant is less than or equal to 12 PSI, ball 38, which is substantially heavier than water, will be pulled downward by gravity out of ball seat 36. Once normally seated in drain line 34, means are thus provided for the water in the upper (bonnet) hydrant barrel to drain freely as shown in FIG. 9.

Figure 12C:
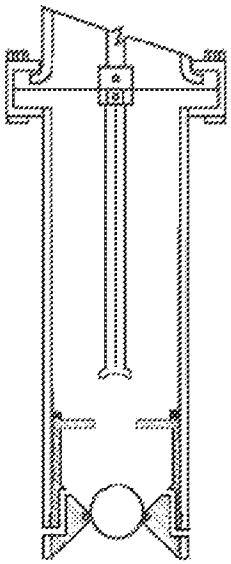
FIG. 12C depicts the main hydrant valve open, but subjected to a reversal in fluid differential pressure (i.e., potential backflow situation)
Figure 12B:
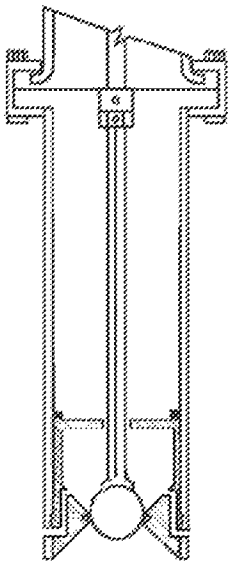
FIG. 12B depicts the main hydrant valve closed.
Figure 12A:
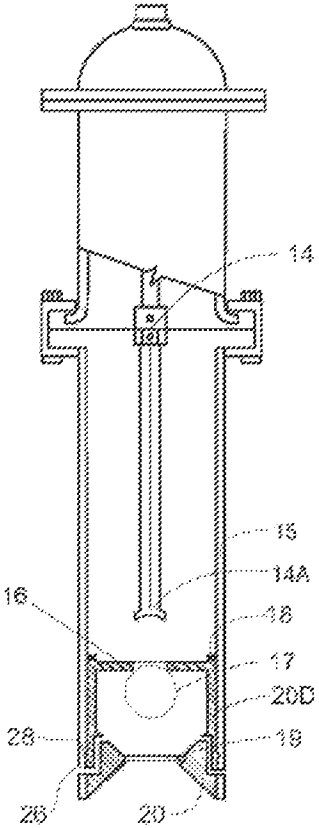
FIG. 12A depicts an exemplary main hydrant valve in the open position and subjected to normal (upward) flow.

FIGS. 12A-12C depict an alternate exemplary embodiment of the present invention, in which axial stem 14 is not connected to retaining screen 16, but rather has cup 14A affixed to its lowest point, while retaining screen 16 is always at a fixed position. The outer diameter of axial stem 14 and cup 14A are smaller than the inner diameter of the central hole of retaining screen 16 (i.e. D2 in the right image of FIG. 4A), allowing axial stem 14 and cup 14A to move through the fixed retaining screen 16 as the main hydrant valve is open and closed. Cup 14A has inner curvature that perfectly matches freely suspended check ball 17 such that when the hydrant valve is closed, Cup 14A pushes freely suspended check ball 17 down into lower ball seat 19, stopping flow.

FIG. 12A depicts this alternate exemplary embodiment when the main hydrant valve is open, i.e. during normal forward flow, thus freely suspended check ball 17 is pushed up against retaining screen 16 (truly resting on a thin film of water as explained later), as the water flows around it through its port holes and central hole exactly as in FIG. 1A.

FIG. 12B depicts this alternate exemplary embodiment when the main hydrant valve is closed, thus axial stem 14 and cup 14A are lowered, pushing freely suspended check ball 17 into lower ball seat 19, stopping flow.

FIG. 12C depicts this alternate exemplary embodiment when the main hydrant valve is open, but a backflow condition prevails in the main hydrant barrel. Thus, freely suspended check ball 17 is pushed by the backpressure into lower ball seat 19, preventing backflow from travelling upstream and contaminating the system.

Figure 13:
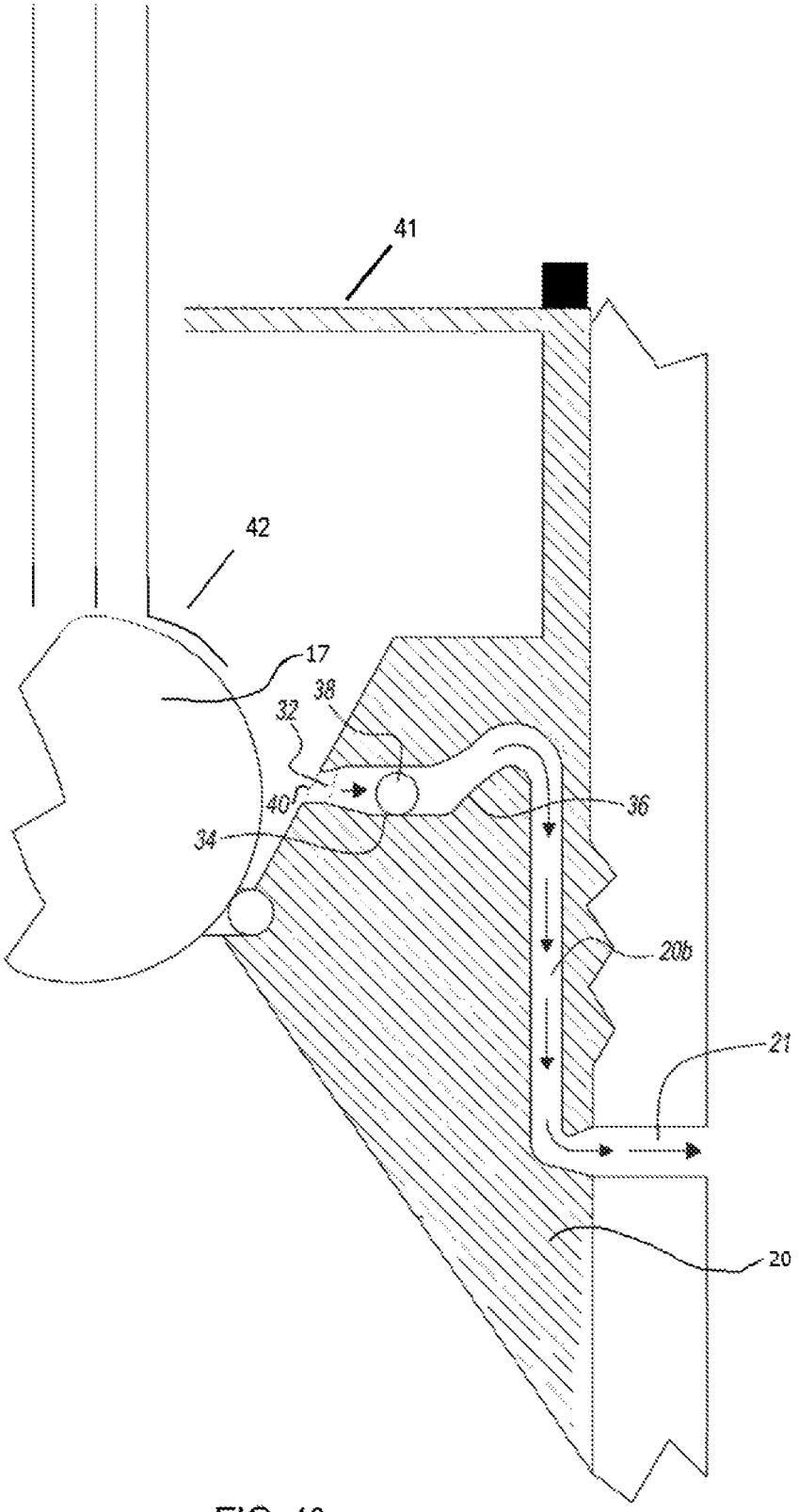
FIG. 13 depicts a cross-sectional exploded view of hydrant's lower assembly while a backflow condition is present in the main valve, according to the embodiment depicted in FIG. 12.

FIG. 13 depicts an exploded cross-sectional view of the lower valve assembly according to the same exemplary embodiment depicted in FIGS. 12A-12C. The main hydrant valve is currently closed, thus the situation is identical to that in FIG. 12B. Axial stem cup 42 is pushing freely suspended check ball 17 into the lower ball seat, stopping flow. It is important to note that in this embodiment of the invention, retaining screen 41 and the rest of the IFCBPV 20 are one physical piece and can be fabricated as such.

Figure 14C:
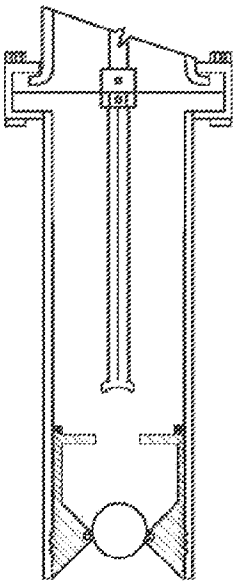
FIG. 14 depict three exemplary cross-sectional views of a wet-barrel fire hydrant provided with an exemplary integrated flow control backflow preventer insert valve as in FIG. 12 (being a wet-barrel embodiment, no drain mechanism)
Figure 14B:
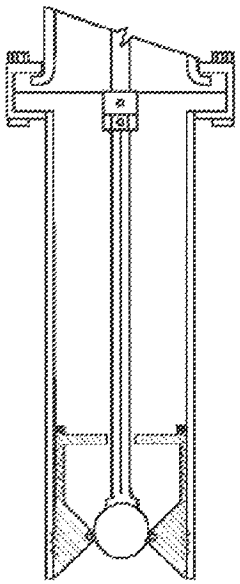
Figure 14A:
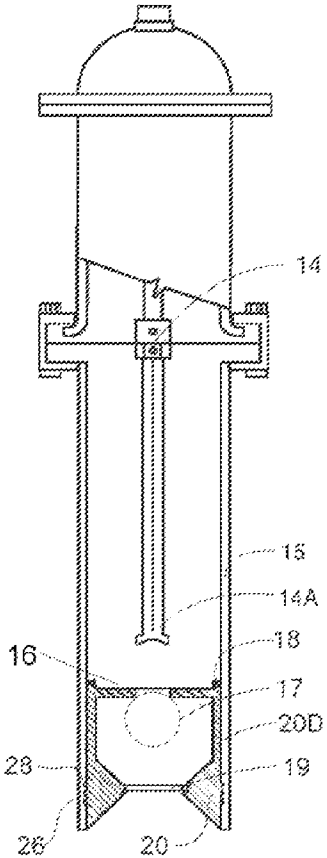

FIG. 14 depict an exemplary embodiment of the present invention applied to a wet-barrel hydrant, thus there is no drain mechanism. The method of opening and closing the hydrant and the particular status of the main hydrant valve in each figure are analogous to those depicted in FIG. 12.

Figure 15:
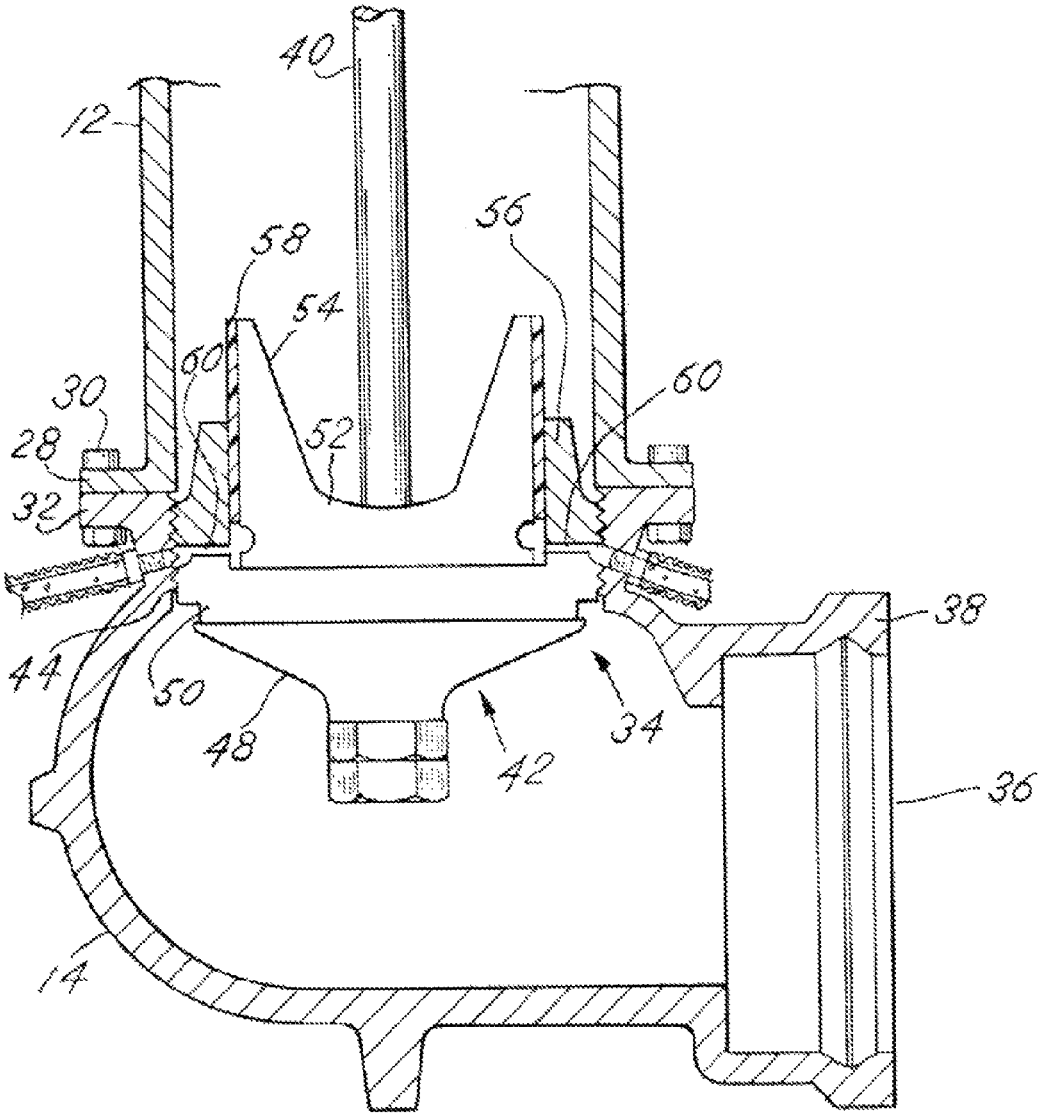
FIG. 15 depicts the lower barrel of an exemplary conventional fire hydrant assembly.

FIG. 15 depicts a conventional dry-barrel fire hydrant when the main hydrant valve is closed. To open the hydrant, the entire assembly comprising (but not limited to) 40, 52, 50, and 48 is lowered creating space for water to flow vertically upward.

In exemplary embodiments of the present invention the position of the freely suspended check ball 17 is governed by the hydrant's operating mode, as follows:

(i) when the main hydrant valve closed, the freely suspended check ball is forced by mechanical means into the lower orifice/ball seat, the ball being in compressive contact with an "O" ring or other optional sealing element, thus precluding normal flow (FIGS. 1B, 3 and 9);

(ii) when the main hydrant valve is open, under normal conditions, water supply distribution pressure forces the freely suspended check ball 17 upward into the concave seat or basket created by the spokes and central ring structure of the underside of the retaining screen (FIGS. 1A, 2 and 10);

(iii) when the main hydrant valve is open, but a backflow condition prevails in the hydrant, the hydrant is now subjected to a reverse differential pressure, i.e., a backflow condition, forcing the freely suspended check ball downward into the lower orifice/ball seat, and into compressive contact with the optional "O" ring or other fluid sealing element (FIGS. 1C and 4). It is noted that the "O" ring or other sealant can insure that integrated flow control/backflow preventer insert valve is essentially leak proof when the hydrant is closed or subjected to a flow reversal.

As noted, ball 17 can have a specific weight that is a function of the working fluid, such as, for example, water. In exemplary embodiments where no gravitational effects are desired to guide the ball, and where the working fluid is water, the specific weight of an exemplary ball can be equal to or slightly greater than one.

In exemplary embodiments of the present invention, an exemplary IFCBPV's cylindrical sleeve barrel extension can have a relatively smooth interior surface as compared to the surface finish of the inner lower barrel of existing hydrants, and can thus reduce the main valve fluid head-loss. Further, it can enhance performance of the freely suspended ball by directing normal fluid flow around the ball then through three or more port holes that are formed by, for example, a tri-radial spoke with central ring structure retaining screen that operates vertically within the sleeve. In addition, during normal flow all fluid flow lines that are intercepted by the curved concave radial spokes on the underside of the retaining screen are redirected behind and under the freely suspended ball, and then through the central ring structure of the retaining screen where said spokes meet. Therefore, as noted above, the freely suspended ball during normal flow is essentially in compressive contact not with the retaining screen per se, but rather riding on a thin film of fluid provided between it and the concave surface of the basket of the retaining screen. This fluid kinetics feature will dramatically increase the life span of the ball and retaining screen.

As noted, in exemplary embodiments of the present invention, an IFCBPV can have, for example, a lower orifice/ball seat. Such a seat can optionally have, for example, an "O" ring, retaining channel (groove), gasket, or any other fluid sealing element, such as, for example, a thermoplastic coated surface, to prevent fluid leakage when either the hydrant is closed (FIG. 3) or a backflow condition occurs (FIG. 4). In this circumstance the freely suspended ball will be in compressive contact with the valve's orifice/ball seat and sealing element, for example, the "O" ring.

In exemplary embodiments of the present invention, the IFCBPV's unique cost-effective design provides for easy and relatively quick installation. Properly installed, it can dramatically improve the security of an entire regional water supply distribution system, covering all residential, commercial and industrial buildings, schools, hospitals, etc. The IFCBPV is thus invisible and tamper resistant, non-corrosive, exhibits low head-loss during normal flow, self-cleaning, and promotes reduced maintenance, dramatically improved security, i.e., tampering, including intentional contamination of any potable water supply system.

As noted above, when the IFCBPV is open, the movement and position of freely suspended check ball 17 is governed by the direction and rate of flow of the water that flows from the bottom of the hydrant, through the stationary housing and then around the ball. Such fluid flow proceeds directly through the three port holes of the retaining screen, except for those lines of flow which are intercepted by the three concave radial spokes and redirected to flow through the central ring structure. This redirected fluid flow creates a stream of fluid between the ball and the retaining screen and, for example, causes the freely suspended ball to move away and off of the concave retaining screen, thereby inducing in-place rotation. In the exemplary embodiments of the present invention the ball and internal structures of the entire apparatus can be made sufficiently smooth and of such hydrodynamic design so as to minimize (i) fluid head-loss, (ii) fouling due to particle and/or suspended solids, (iii) maintenance, and to insure that the caged suspended ball can instantly respond to changes in fluid pressure, whether large or small, and in any direction.

It would be extremely difficult for anyone to either accidentally or intentionally breach the security of a hydrant having the aforementioned design features, even using a high pressure pump, hose and mobile tanker to inject a CBR toxic agent through the hydrants discharge ports or external drain port holes into the regional water supply system.

As noted, during normal flow, hydraulic conditions will force ball 17 to instantly position itself on the mated concave surface of the retaining screens concave radial spokes 16, and axial ring structure and stay there. The retaining screen with the concave radial spokes, a central ring and three portholes provide means for an exemplary ball to be instantly displaced and hydraulically forced off of the retaining screen's basket (comprising the concave spokes and the central ring) when the flow reverses, regardless of the reverse (backflow) rate of flow due to the balls specific weight relative to the surrounding fluid and gravity since the IFCBPV is in a vertical orientation. Such functionality allows for immediate seating of the ball even under very low reverse flow conditions, such as where the backflow pressure differential is very low, as might be applied in an attempt to defeat a conventional check valve.

It is noted in this context that such a small backpressure can be quite common. Where system pressure is relatively high, an attempted compromise of the water system via a backflow introduction of a noxious substance would often operate under a small net backpressure, it being difficult to generate a large backpressure against an already large forward pressure of, for example, 70 psi, and still remain undetected.

As noted, the concave radial spokes guide fluid during normal flow towards and through the central ring, thereby providing for a thin film of fluid between the seated ball and the basket, particularly during periods of high flow. This allows the ball to rotate randomly while seated and provides a self-cleaning action thus keeping the ball free of deposits or build-up.

Thus, the ball's position within the IFCBPV can be governed entirely by the direction and velocity of the flow, the surface area of the suspended ball, friction, fluid viscosity, the forces associated with the flowing fluid and gravity.

Thus, in exemplary embodiments of the present invention, an IFCBPV can prevent fluid backflow from the valve's fluid outlet to the valve's fluid inlet when the pressure at the fluid inlet is less than the pressure at the downstream fluid outlet. As long as the fluid pressure—the normal flow condition—is greater at the IFCBPV's fluid inlet end (upstream—bottom of hydrant) relative to that at the valve's fluid outlet end (downsteam—top of hydrant), the ball will position itself near the basket of the underside of the retaining screen.

Ball 17 thus assumes a new position relative to the concave spokes and ring structure of the bottom of retaining screen 16 each time flow ceases and normal flow is resumed, and similarly assumes a new position on the lower valve seat and "O" ring 19 when the check valve is subjected to a flow reversal. This operational characteristic can insure, for example, continuous self-cleaning action of the ball inasmuch as ball 17 can, for example, automatically position itself differently on retaining screen 16 each time the flow cycles on and off, thus exposing a different part of the ball's outer surface to the scouring velocity of the flowing fluid.

Recognizing the critical function of exemplary IFCBPVs according to the present invention to safely and effectively protect potable water systems from accidental or intentional reverse flow contamination, and, to insure safe, and essentially maintenance free operation over a protracted period, selected materials can be identified for an exemplary valve's construction. Such housing materials can include, for example 304L, 316, 904L stainless steel, lead-free brass, Hasteloy C-22 or other advanced materials deemed safe by appropriate testing organizations, e.g., NSF. Materials for the freely suspend hollow ball can include, for example, 304L, 316, 904L stainless steel, Hasteloy C-22, or special advanced light-weight polymers, such as, for example, acetal, PVC, CPVC, amorphous high performance thermoplastics that offer excellent mechanical and chemical resistance. Appropriate materials for the "O" ring can include, for example, EPDM, Perfluoroelastomer, Viton or the equivalent.

As noted, in exemplary embodiments of the present invention the radial spoke retaining screen can be formed by three or more equidistant radial spokes, which can, for example, join at a central ring structure and can, for example, have a concave surface on the underside (upstream side) of the retaining screen. Such exemplary three or more radial spokes can also, for example, possess two additional important design features: a flat leading edge, and a tapered trailing edge ("leading" refers to the portion of the spoke nearest the periphery, and "trailing" refers to the portion of the spoke nearest the central ring). The tapered trailing edge can insure, for example, that freely suspended check ball 17 instantly responds to even a very low backflow flow condition. Such a tapered trailing edge can improve the fluid dynamics of the valve by redirecting the freely suspended check ball 17 and forcing it into the lower valve seat and, for example, "O" ring 19 when flow, whether large or very small, reverses direction. Additionally, a flat leading edge (i.e., the part of the spoke being essentially flat, or perpendicular, to the forward flow) revealed a critical interdependent relationship with clearly enhanced ball stability over a wide range of fluid flow. The flat leading edge provides means for the three tapered radial spokes to intercept and redirect a fraction of the fluid flowing during normal flow, which is perpendicular thereto, towards the (hollow) central ring.

Additionally, in exemplary embodiments of the present invention, the spokes can be tapered on their downstream side, and flat or even grooved on their downstream side. The taper on the upstream side allows for the fluid flow to easily flow past the spoke, and the grooving on the upstream side can be used to better guide and redirect the fluid down the (upstream side of the) spoke and towards the ball, thus focusing the layer of water on which the ball "rides" during forward flow, as noted above. As well, in exemplary embodiments, the width of the spokes can vary along their radial dimension, being narrower as they reach the central ring, so as to also achieve desired fluid flow characteristics.

Bench observations of various exemplary embodiments have confirmed a very slow rotation of an exemplary ball 17, clearly indicating that the ball was not in compressive contact with the radial spoke retaining screen itself, but rather, as described, riding on a very thin film of the surrounding fluid, which was very apparent when the valve was subjected to normal flow rates greater than 2 gpm, in a ½ pipe. This creates an important and unique self-cleaning feature that is clearly associated with the unique flat surface design of the three concave radial spokes and central ring structure.

Conventional backflow preventer check valves that rely on some form of a mechanical device, such as a spring, tether, etc., to provide the necessary control when such a valve is subjected to normal or reverse flow, and thus require periodic service and are prone to frequent malfunctions. In contrast, an exemplary IFCBPV has no spring loaded mechanical mechanism appended to or in compressive contact with the freely suspended ball to control the ball's position inside the check valve when the valve is subjected to normal or reverse flow. The operational characteristics of such a freely suspended caged ball are governed entirely by the IFCBPV's unique design and the working fluid's characteristics, such as viscosity, temperature, etc. It is noted that the IFCBPV is also distinguished by having a low head-loss and being self-cleaning.

Again, experimental bench tests were conducted to observe the response of an exemplary valve of the type used in an IFCBPV when subjected to normal and reverse flow. Such performance tests used a check valve having elements similar in principal from a fluid kinetics perspective to those previously described. The backflow preventer was inserted into a thermoplastic transparent tube having an ID equivalent to a ½ inch schedule 40 water supply pipe, nominal ID 0.62 inches, municipal water pressures during normal flow tests ranged from 50-75 psi. The 1.5 inch long backflow preventer insert valve performed flawlessly over the entire normal flow range 0-5 gpm. In-place rotation of the freely suspended ball was observed, albeit slow, during normal flow when the freely suspended ball was immediately adjacent, almost touching retaining screen radial spoke and central ring structure and subjected to flow rates that exceed 2-3 gpm. No chatter or longitudinal oscillations could be observed when the check valve and ball were subjected to flows ranging from 0-5 gpm. The 5 gpm flow rate equates to a sustained maximum fluid velocity of 7.5 ft/s, Reynolds number Re≈20,000, based on the following critical check valve dimensions and fluid properties: exemplary ball diameter 0.375 in., three radial spokes of width (upstream concave face) 0.095 in., and, a minimum distance of 0.5 inches maintained between the valve's retaining screen, and a 60° F. water temperature.

The application of dimensional analysis and hydraulic similitude followed by appropriate computer simulations and prototype model evaluations was done in-part to replicate the observed results for larger check valves.

It is noted that to appreciate the unique attributes of exemplary IFCBPVs according to the present invention, reference is made to Vallentine, H. R., *Applied Hydrodynamics* (London, 1959). Vallentine describes at 63-74, "Turbulent flow and the boundary layer," and "Velocities in the boundary layer." These discussions are followed by a section called "Boundary layer separation" at 71-73.

Vallentine describes "boundary layer separation" vis-à-vis sphere fluid kinetics as relates to converging and diverging lines of flow.

> The foregoing comments on the characteristics of boundary layer flow presuppose a zero pressure gradient along the boundary outside the boundary layer and the absence of 'separation', a phenomenon of major importance in the determination of patterns of flow. The term 'separation of the boundary layer' implies a departure of the boundary layer from the boundary (FIG. 2.10).
>
> The growth in thickness of the boundary layer with the distance along a wall results from the continuous retardation of the fluid elements due to boundary shear. If, owing to the shape of the flow boundaries, the streamlines are converging in the direction of flow, the convective acceleration effects tend to offset the effects of boundary shear in retarding the fluid elements, thereby opposing the growth in the thickness of the boundary layer. In other words, the negative pressure gradient associated with convective acceleration tends to limit the growth of the boundary layer.
>
> If, on the other hand, the boundary form is such that the streamlines diverge, there will be a positive, or adverse, pressure gradient in addition to the boundary shear acting to retard the flow near the wall. The effect is evident in the series of velocity distributions shown in FIG. 2.10. The flow near the wall is continually retarded until, at S, its velocity is zero. To the right of S, the fluid motion is in the reverse direction and the oncoming fluid has moved away from the boundary. Once such separation occurs, the pressure distribution becomes modified and the line of separation moves upstream to a position of equilibrium. (Emphasis added)
>
> In FIG. 2.10, the pattern is essentially that of separation of a laminar boundary layer. In the case of a turbulent boundary layer, the mixing action of turbulence delays separation by carrying some of the slow-moving fluid away from the boundary and bringing in fluid of higher kinetic energy content to replace it. The general effect is to delay separation by moving the point of separation downstream or, if the deceleration is sufficiently gradual, to maintain flow without separation until the included half-angle exceeds 4°.

In light of this description of normal flow near a spherical surface, and in particular the fact that "To the right of S, the fluid motion is in the reverse direction," experimental observations clearly show that when certain valve dimensions are not maintained, longitudinal (axial) force imbalances develop. Forces behind the sphere, ball 17, now dominate in the reverse direction to the extent that the freely suspended caged ball 17 is forced upstream against and overcoming the downstream force associated with the normal flow water pressure. (In this circumstance an unacceptable hydrodynamic condition may develop to the extent that fluid motion and attendant forces in the reverse direction exceed the normal downstream force.) Once the freely suspended exemplary ball 17 is literally thrust upstream to the extent that it is forced against the valves proximal orifice seat normal downstream flow is terminated, however, only momentarily. Cessation of normal flow naturally results in the instantaneous termination of reverse fluid motion and its attendant force, thereby nullifying the force imbalance that initially caused the flow reversal direction, which forced the freely suspended check ball 17 upstream. At this point the freely suspended caged ball 17 is forced downstream by normal flow fluid pressure until it is thrust against the retaining screen's radial spokes, whereupon the cycle repeats, until normal flow to the valve is terminated.

To insure complete scientific understanding of the observed slow in-place rotation of exemplary ball 17 during normal flow without any observed perturbations, as well as the self-cleaning phenomenon when the ball is positioned immediately adjacent to a retaining screen and using tapered radial spokes and flow rates exceeding 2 gpm, reference is made to a technical paper by V. A. Gushchin and R. V. Matyushin, *Vortex Formation Mechanisms in the Wake Behind a Sphere for* 200<Re<380, Fluid Dynamics, Vol. 41, No. 5, pp. 795-809 (2006).

The aforementioned study provides a detailed analysis of the fluid kinetics at (i) the forebody of a sphere, (ii) the sphere, (iii) immediately downstream of a sphere and (iv) beyond, i.e., the wake behind a sphere by "direct numerical simulation and visualization of three-dimensional flows of a homogeneous incompressible viscous fluid" so as to describe as comprehensively as possible the many and varied vortex formations behind a sphere at moderate Reynolds numbers. Of their numerous findings whose focus was vortex formation behind a sphere, several observations clearly relate to the freely suspended caged ball 17 in the check valve presented herein.

First, "only insignificant oscillations of the rear stagnation point" were detected. Not surprising considering their evaluation did not exceed a Reynolds number 380 vs. 20,000 that showed similar results providing appropriate critical dimensions were maintained for the check valve.

Second, and of equal significance, it was confirmed that a fluid moving initially longitudinally, e.g., through a pipe can generate lateral and rotational forces as it passes a sphere even when Reynolds numbers are relatively low <380. Specifically, citing the study a "lateral force ($C_l$)" and "rotational moment ($C_{T,y}$)" were observed "about a line passing through the sphere center and perpendicular to the plane of symmetry of the wake, are different form zero . . . . "

This finding confirms the existence of lateral hydrodynamic forces that can cause a sphere that is freely suspended and not in compressive contact with a stationary surface to rotate in-place, a beneficial self-cleaning phenomenon observed in our bench tests that can have considerable significance in future check valve design.

In exemplary embodiments of the present invention, for reverse flow, the lower valve seat (annulus) can have, for example, a circular flat surface that is inclined to the longitudinal axis, forming a surface that resembles a truncated cone, or alternately, an exemplary ball seat can be, for example, circular and simultaneously have a circumferentially mated seat whose surface is identical to the radius of the ball.

If there is no flow the freely suspended check ball 17 will sink because the specific weight is slightly greater than the working fluid.

Further for a metal ball to be corrosion resistant and have a specific weight that is substantially equal to that of the surrounding fluid, e.g., Hasteloy C-22, it must be hollow and structurally sound to insure long-term maintenance free performance.

Properly installed, an exemplary IFCBPV valve is invisible, chemically resistant and can be performance tested by remote means. Such a ball and valve assembly cannot easily be compromised, from a fluid kinetics perspective even when subjected to a corrosive chemical.

It can operate properly under a wide range of normal flow rates for a given pipe size, and can perform as intended when subjected to exceptionally low backflow rates and differential pressures. The valve can be self-cleaning and less prone to pebble fouling of the sealing element, in this case, the "O" ring.

The IFCBPV according to exemplary embodiments of the present invention can provide self cleaning, super-low head loss and cost-effective protection for an individual regional water supply system and subsystems from being compromised by either an accidental or intentional cross connection.

Thus, in exemplary embodiments of the present invention, an exemplary IFCBPV:

1. Can be installed into an existing or new fire hydrant with relative ease;
2. Can be chemically resistant and highly tamper resistant;
3. Can be mechanically simple with only one main valve moving part, a self-cleaning ball that rides on a layer of moving water, thus insuring extended maintenance and trouble free operation;
4. Can be housed in a valve body that has a flow transition zone to minimize hydraulic head loss when the valve is operating in the normally open position;
5. Can have orifice with a recessed edge design so as to enhance sealing characteristics of the ball under reverse flow, and allowing the ball to freely move off of the seat when fluid flow returns to normal;
6. Can easily be tested as to proper operation without having to expose or remove it from within a pipe, by connecting a fluid injecting apparatus (pump) to an appropriate hydrant spout, opening the valve, activating the fluid injector or pump and observing system pressure and fluid flow; and
7. Can be easily manufactured, installed and serviced, when and if necessary.

Additionally, in exemplary embodiments of the present invention, numerous products and variations thereon can, for example, be provided, including, but not limited to, for example, an IFCBPV insert with check-ball type backflow protection, a Dry-barrel hydrant with such an IFCBPV, a wet-barrel hydrant with such an IFCBPV, hydrants equipped with such IFCBPV's where an axial stem is connected to the retaining screen in order to open/close the hydrant, hydrants equipped with such IFCBPV's where axial stem has a cup on its end, but retaining screen is fixed, and opening/closing accomplished by axial stem going through hole in retaining screen and releasing/pushing ball from/into lower ball seat, such an IFCBPV insert for dry-barrel hydrants where the drain mechanism is a spring-loaded piston (where it is noted, axial stem and retaining screen are connected), and such an IFCBPV insert for dry-barrel hydrants where the drain mechanism is a check-ball style, as in a main hydrant barrel.

Modifications and alternative embodiments of the invention will be apparent to those skilled in the art in view of the foregoing description. This description is to be construed as illustrative only, all example dimensions are only exemplary and not limiting in any way, and is for the purpose of teaching those skilled in the art the best mode of carrying out the invention. The details of the structure and method may be varied substantially without departing from the spirit of the invention and the exclusive use of all modifications, which come within the scope of the appended claims, is reserved.

What is claimed:

1. A dry-barrel fire hydrant valve, comprising:

a valve body, comprising:

a movable retaining screen at an upper end;

an axial shaft connected to an upper portion of the retaining screen;

a ball seat at a bottom end;

a ball; and one or more barrel drains integrated within the valve body, each drain comprising a ball within a tube, the tube having a narrower diameter at its ends than in its middle portion, and the ball having a specific gravity somewhat higher than that of the surrounding fluid, wherein the valve is opened by a user causing the moveable retaining screen to rise, allowing the ball to be pushed upwards by fluid pressure, and closed by causing said retaining screen to push the ball downward and seal on the ball seat;

wherein the ball is caged between the retaining screen and the ball seat, the ball has a specific weight slightly greater than the specific weight of a fluid to be sent through the valve, wherein, when the said retaining screen is raised:

in forward flow the ball is held in a position adjacent to the retaining screen such that forward fluid flow is facilitated, and in backwards flow the ball seals in the ball seat, thus preventing backflow.

2. The dry-barrel fire hydrant valve of claim 1, wherein, each barrel drain further comprises:

a horizontal inlet port and ball seat and a downstream angular positioned ball seat and outlet port, a horizontal pipe in fluid communication with said inlet and outlet ball seats and ports; and a ball with a specific weight greater than the specific weight of a fluid supplied by the fire hydrant, wherein when the valve is open the ball is pushed to block off the outlet port, when the valve is closed the ball seats in the ball seat, and when a fluid pressure is applied form the outside of the hydrant at the outlet port, the ball is pushed to block off the inlet port, preventing backflow into the hydrant.

3. The valve of claim 1, wherein the valve body has an outside diameter with a mating outside thread arranged to mate with a hydrant's lower interior thread such that when installed the valve is not visible from the outside.

4. The valve of claim 1, wherein said valve seat further comprises an "O" ring or other fluid sealing material.

5. The valve of claim 1, wherein the retaining screen has a concave surface on its upstream side, and has equidistant radial spokes meeting at a central ring, and wherein in forward flow the ball is held in position by the retaining screen, and fluid flows between said spokes and through said ring.

6. The valve of claim 5, wherein the central ring is at substantially the axial center of the retaining screen and the valve body.

7. The valve of claim 1, wherein the ball is self-cleaning.

8. The valve of claim 5, wherein each radial spoke has a tapered trailing edge and a flat leading edge.

9. The valve of claim 1, wherein the valve body has a flow transition zone to minimize hydraulic head-loss when the valve is in the normally open position.

10. The valve of claim 2, wherein the inlet port of the drain valve has a slightly smaller diameter than a drain hole of a hydrant into which the valve is inserted.

11. The valve of claim 1, further provided with fastening means to mate with fastening means of an existing fire hydrant, such that it can be easily retrofitted therein.

12. The valve of claim 11, wherein said fastening means include one or more of outer threads or fasteners to match or mate with inner threads or fasteners of a conventional existing hydrant "seat ring".

13. The valve of claim 1, wherein at least one of:

the valve body has an outside diameter with a mating outside thread arranged to mate with a hydrant's lower interior thread such that when installed the valve is not visible from the outside, and The valve seat further comprises an "O" ring or other fluid sealing material.

14. The valve of claim 1, wherein the retaining screen has a concave surface on its upstream side, and has equidistant radial spokes meeting at a central ring, and wherein in forward flow the ball is held in position by the retaining screen, and fluid flows between said spokes and through said ring.

15. The valve of claim 14 wherein the central ring is at substantially the axial center of the retaining screen and the valve body.

16. The valve of claim 1, wherein the ball is self-cleaning.

17. The valve of claim 1, wherein each radial spoke has a tapered trailing edge and a flat leading edge.

18. The valve of claim 1, wherein the valve body has a flow transition zone to minimize hydraulic head-loss when the valve is in the normally open position.

* * * * *